US006021647A

United States Patent [19]

Ameringer et al.

[11] Patent Number: 6,021,647

[45] Date of Patent: Feb. 8, 2000

[54] ETHYLENE PROCESSING USING COMPONENTS OF NATURAL GAS PROCESSING

[75] Inventors: Greg E. Ameringer, 1015 Nashua, Houston, Tex. 77008; Nasar Ullah Nasar, 1102 Ivy Wall Dr., Houston, Tex. 77079

[73] Assignees: Greg E. Ameringer; Nasar Ullah Nasar, both of Houston, Tex.; Lonnie Zack Mallory; George M. Hood; a part interest

[21] Appl. No.: 09/084,067

[22] Filed: May 22, 1998

[51] Int. Cl.[7] ..... F25J 5/00

[52] U.S. Cl. ..... 62/631; 62/935

[58] Field of Search ..... 62/618, 620, 623, 62/630, 631, 935

[56] References Cited

U.S. PATENT DOCUMENTS

| | | | |
|---|---|---|---|
| 2,577,701 | 12/1951 | Deming et al. | 62/630 |
| 3,309,882 | 3/1967 | Cabanaw | 62/631 |
| 3,367,122 | 2/1968 | Tutton | 62/935 |
| 3,444,696 | 5/1969 | Geddes et al. | 62/623 |
| 5,768,913 | 6/1998 | McCue et al. | 62/625 |

FOREIGN PATENT DOCUMENTS

| | | | |
|---|---|---|---|
| 7710938 | 4/1978 | Netherlands | 62/935 |

*Primary Examiner*—William Doerrler
*Attorney, Agent, or Firm*—James F. Weiler

[57] ABSTRACT

Disclosed are methods of and means for producing ethylene by chilling the ethylene plant demethanizer heat exchange train with a refrigerated stream or streams from a cryogenic natural gas plant effective to provide ethylene level refrigeration, by condensing the ethylene distillation tower overhead with ethylene level refrigeration stream or streams from the cryogenic natural gas plant, by refluxing the ethylene plant demethanizer distillation column with a predominantly liquid methane mixture from the cryogenic natural gas plant, and by combinations thereof. Significant advantages in capital and operating costs associated with ethylene production.

8 Claims, 13 Drawing Sheets

ETHYLENE PROCESSING USING COMPONENTS OF NATURAL GAS PROCESSING

FIELD OF THE INVENTION

The field of the invention is ethylene processing and natural gas processing.

BACKGROUND OF THE INVENTION

Natural gas from the wellhead is a mixture of various different gases including methane, ethane, propane, butane, etc. Natural gas liquid ("NGL") processing plants liquefy and extract the ethane, propane, butane, etc. and sell these products as feedstock to petrochemical plants and refineries or to distributors to be sold as a home heating fuel. All of the ethane and much of the propane from NGL plants ultimately are used as feedstock in ethylene plants. Here the ethane and propane are cracked into ethylene and propylene which are themselves then used as feedstock in various chemical and plastic processes. Today, the NGL plant and the ethylene plant are totally separated with the only connection between them being a pipeline. The present invention brings components of these two plants together and integrates them to substantially reduce the manufacturing cost of ethylene.

There are several different types of NGL plants including mechanical refrigeration, lean oil and cryogenic turboexpander. Of these, the cryogenic turboexpander plant is the most common and the only one capable of deep ethane recovery. Within the cryogenic turboexpander family there are actually two basic types of plants, the standard types and the refluxing types. The standard type, which is representative of earlier designs, has the expander discharge entering the top of the demethanizer and has an ethane recovery of approximately 65 to 75%. The refluxing types, which are a more modern design, have the expander discharge entering the middle of the demethanizer and a second stream that has been condensed in a reflux condenser entering or (refluxing) the top of the tower. These designs have an ethane recovery of approximately 85% to 99%. In the subsequent review of the prior art, the more modern refluxing type of cryogenic turboexpander gas plant is capable of 95+% ethane recovery.

Today, there are numerous ethylene plant technologies. Each one similar but different enough such that they can claim advantage over the other. Instead of reviewing each such technology, for purposes of disclosure of the prior art, a simple design, representative of current technology has been chosen. The main ethylene plant design as well as the supporting ethylene and propylene refrigeration systems are discussed in detail in later sections. While NGL gas plants and ethylene plants have operated side by side, to applicant's knowledge, components of these two plants have never been integrated to substantially reduce the capital and operating costs of manufacturing ethylene.

SUMMARY OF THE INVENTION

A first embodiment of the invention is in a cryogenic natural gas plant to use the gas plant as a methane refrigeration system to provide ethylene level refrigeration in the ethylene plant demethanizer heat exchange train.

A second embodiment of the invention is really an extension of the first embodiment thereof, that is, use of the cryogenic natural gas plant as a methane refrigeration system to produce ethylene level refrigeration in the ethylene plant. Here, ethylene level refrigeration is produced by the gas plant to condense ethylene tower reflux and/or product.

In effect, as demonstrated later, the ethylene tower heat pump is placed onto the gas plant methane refrigeration system.

A third embodiment of the present invention is to use a mostly liquid methane mixture from a natural gas plant to reflux the ethylene plant demethanizer. By using the liquid methane from the gas plant, the pressure the cracked gas in the ethylene plant must be compressed to is decreased from 475 psig to approximately 200 psig.

While each of the foregoing embodiments of the invention can be utilized advantageously in ethylene processing, or combined one with another, combining all three together can reduce the capital and operating costs associated with ethylene manufacture up to almost 50 percent. Accordingly, a fourth embodiment of the invention is to combine all of the foregoing embodiments of the invention.

Accordingly, it is an object of the present invention to provide a method of and means for producing ethylene which substantially reduces capital and operating costs over current prior art ethylene production.

It is a further object of the present invention to provide an improved method and means for producing ethylene utilizing an ethylene plant demethanizer comprising chilling the heat exchanger train in front of the ethylene plant demethanizer with a refrigerated stream or streams from the cryogenic natural gas plant effective to provide ethylene level refrigeration.

It is yet a further object of the present invention to provide improved methods of and means for producing ethylene utilizing an ethylene distillation tower by condensing the ethylene distillation tower overhead with an ethylene level refrigeration stream or streams from a cryogenic natural gas plant.

It is yet a further object of the present invention to provide an improved method of and means for producing ethylene by refluxing the ethylene plant demethanizer with a predominantly liquid methane mixture from a cryogenic natural gas plant.

It is a further object of the present invention to greatly reduce or eliminate completely the costly cascade ethylene refrigeration system found in prior art ethylene processing.

It is still a further object of the present invention to greatly reduce or eliminate completely the costly propylene refrigeration found in prior art ethylene processing.

It is a further object of the present invention to reduce the inlet cracked gas compression in the ethylene plant by approximately 25 percent thereby reducing capital and operating costs associated with ethylene production.

Other and further objects, features, and advantages appear throughout the specification and claims.

DESCRIPTIONS OF PREFERRED EMBODIMENTS OF THE INVENTION

As set forth before herein, a first embodiment of the invention is to reduce and/or replace the mechanical ethylene refrigeration system required in the ethylene plant demethanizer heat exchanger train by using the cryogenic natural gas plant as a refrigeration system for the ethylene plant to produce incremental internal ethylene level refrigeration; a second embodiment is to reduce and/or replace the mechanical ethylene refrigeration required in the ethylene distillation tower to condense ethylene distillation tower reflux and/or product by again using the cryogenic natural gas plant as a refrigeration system for the ethylene plant to produce incremental internal ethylene level refrigeration, and a third embodiment is to use liquid methane produced in a natural gas plant to reflux the ethylene plant demethanizer. Any one of these embodiments produces significant advantages; however, maximum benefit comes from combining all three embodiments of the invention.

For purposes of disclosure, the following examples 1 and 2 are of prior art cryogenic natural gas plants, and examples 3, 4, and 5 are prior art examples of current ethylene plants and processing. The examples are illustrative only and are simple designs representing current technology.

EXAMPLE 1

Prior Art—Cryogenic Natural Gas Plant

Figure 1:
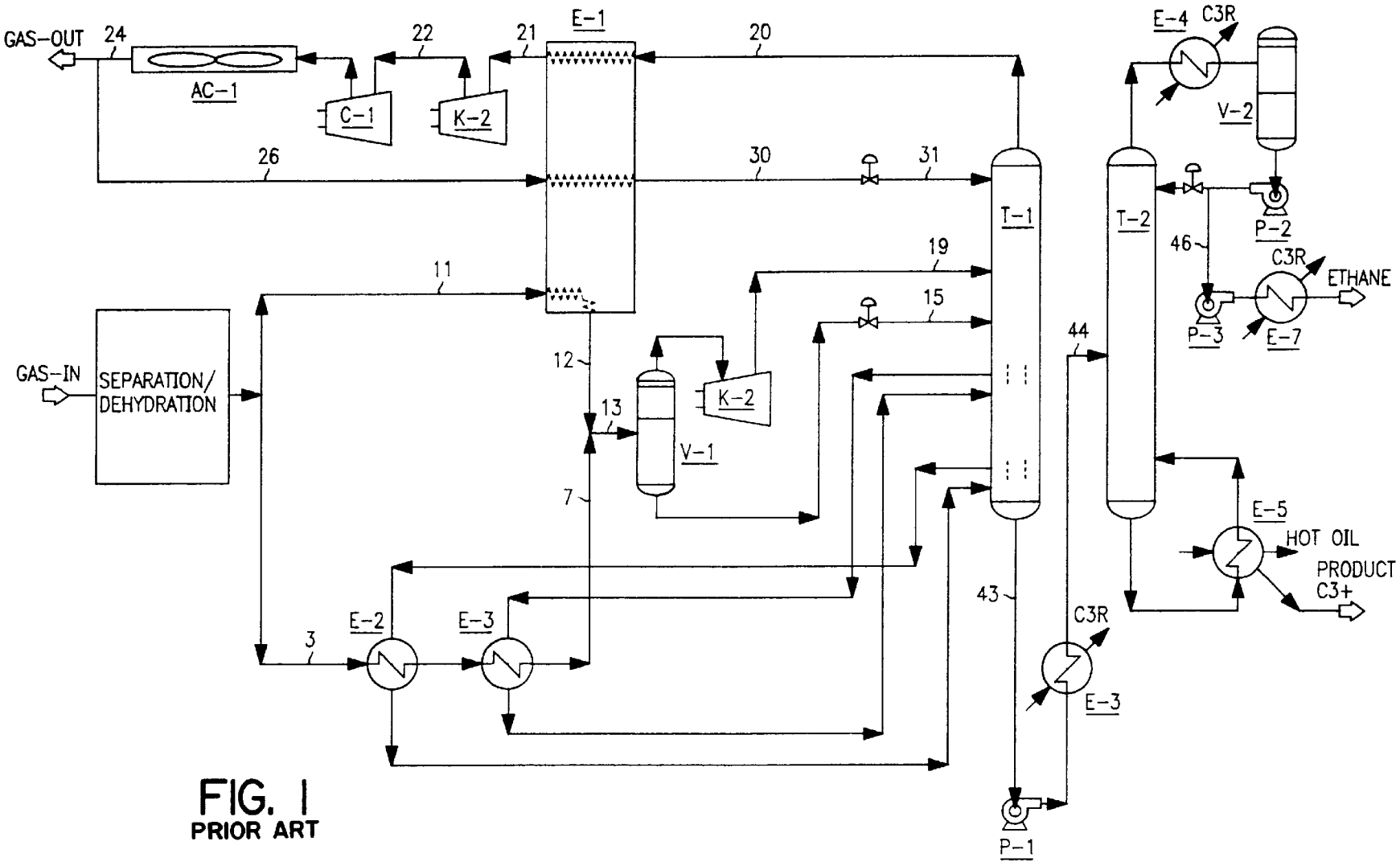
FIG. 1 PRIOR ART
FIG. 1 is a diagram of a conventional prior art cryogenic turboexpander natural gas plant.

Illustrated in FIG. 1 is a modern, high ethane recovery, cryogenic natural gas turboexpander plant. Inlet gas composition, pressure and temperature can vary greatly from plant to plant but for purposes of disclosure the inlet gas composition and plant performance specifications given in Table 1 are used.

TABLE 1

Natural Gas Turboexpander Plant Specifications

| | |
|---|---|
| Inlet Flow (mmscfd) | 400 |
| Inlet Pressure (psig) | 800 |
| Outlet Pressure (psig) | 800 |
| Inlet Temperature (° F.) | 80 |

| | INLET | | RECOVERED | | |
|---|---|---|---|---|---|
| | MOL % | BPD | BPD | lb/hr | RECOVERY % |
| Methane | 91.75% | — | — | — | — |
| $CO_2$ | 0.47% | — | — | — | — |
| Ethane | 4.62% | 11,756 | 11,700 | 60,775 | 99.5% |
| Propane | 1.75% | 4,575 | 4,575 | 33,854 | 100.0% |

TABLE 1-continued

Natural Gas Turboexpander Plant Specifications

| | | | | | |
|---|---|---|---|---|---|
| I-Butane | 0.45% | 1,403 | 1,403 | 11,515 | 100.0% |
| N-Butane | 0.45% | 1,352 | 1,352 | 11,516 | 100.0% |
| N-Pentane | 0.25% | 874 | 874 | 8,038 | 100.0% |
| N-Hexane | 0.24% | 992 | 992 | 9,600 | 100.0% |
| Recompressor HP | | | | | 23,200 |

*NOTE: BPD = Barrel per day

In FIG. 1, natural gas at a flow rate of 400 mmscfd enters the plant at a pressure of 800 psig and a temperature of 80° F. The inlet gas is first dehydrated using molecular sieve and then split into two streams 3 and 11. The stream 3 split contains approximately 37.5% of the total inlet gas or 150 mmscfd and is directed through two exchangers, the demethanizer bottom reboiler E-2 and the demethanizer side reboiler E-3. This inlet gas stream provides the heat for the demethanizer T-1 reboilers while chilling the inlet gas to a temperature of −25° F.

The stream 11 split contains approximately 62.5% of the total inlet gas or 250 mmscfd and flows to the gas/gas heat exchanger E-1. Here the gas is chilled to a temperature of −48° F. through heat exchange with the cold demethanizer T-1 overhead residue stream 20. The two inlet streams are now recombined in stream 13 and flow to the cold separator V-1 at a combined temperature of −40° F. and 778 psig. The cold gas off the top of the Cold Separator V-1 is now expanded through the turboexpander K-2 into the demethanizer T-1. Stream 19 enters the demethanizer T-1 approximately two thirds up from the bottom of the tower at 320 psig and −109F.

The overhead residue gas from the demethanizer T-1, after heat exchange in the gas/gas exchanger E-1, leaves the exchanger at 315 psig and 67° F. and flows to the booster compressor K-2 which is directly coupled to the turbo expander K-2. Here the gas is compressed, using work from the turbo expander, to a pressure in stream 22 of 390 psig and 101° F. The residue gas now flows to the residue gas recompressor C-1 where it is compressed back to the inlet pipeline pressure of 800 psig. The compressed residue gas is then cooled via air cooling to a temperature no greater than 120° F. in stream 24.

To provide reflux for the demethanizer T-1, approximately 150 mmscfd of residue gas is recycled to the gas/gas exchanger E-1 in stream 26. The gas is condensed and subcooled to a temperature of −148° F. and 792 psig in stream 30 through heat exchange with the cold demethanizer T-1 overhead gas in stream 20. The condensed liquid is flashed to the demethanizer T-1 pressure of 320 psig in stream 31 and enters the top of the demethanizer T-1 at a temperature of −155° F.

Also entering the demethanizer T-1 is the cold separator V-1 liquids that have been flashed to the demethanizer T-1 in stream 15. These liquids enter the tower just above the mid point at a temperature of −71° F. In the demethanizer T-1, the liquid NGL product is demethanized to a ratio of no greater than 3% methane to ethane. The reboiler heat for the demethanizer T-1 is provided by chilling inlet gas in the demethanizer side and bottom reboilers, E-2 and E-3.

The NGL product leaves the bottom of the tower at a temperature of 56° F. and 320 psig and is pumped to the deethanizer T-2 pressure of 400 psig. Before entering the deethanizer T-2, the NGL product is heated though exchange with propane refrigerant providing subcooling to the propane in refrigerant subcooler #1 E-6. Stream 44 enters the deethanizer T-2 approximately two thirds up from the bottom of the tower at 400 psig and 63° F.

From the deethanizer T-2, a liquid ethane product and a liquid C3+ NGL product are made. The ethane product is pumped to the pipeline pressure of approximately 800 psig and before leaving the plant is heat exchanged with propane refrigerant in refrigerant subcooler #2 E-7 to provide additional subcooling for the propane. The ethane product leaves the plant at pressure of 800 psig and 90° F. The C3+ NGL product is now either further fractionated into its individual components or sold as a mixed product via truck or pipeline.

EXAMPLE 2

Cryogenic Gas Plant (Prior Art)-Propane Refrigerant System

Figure 2:
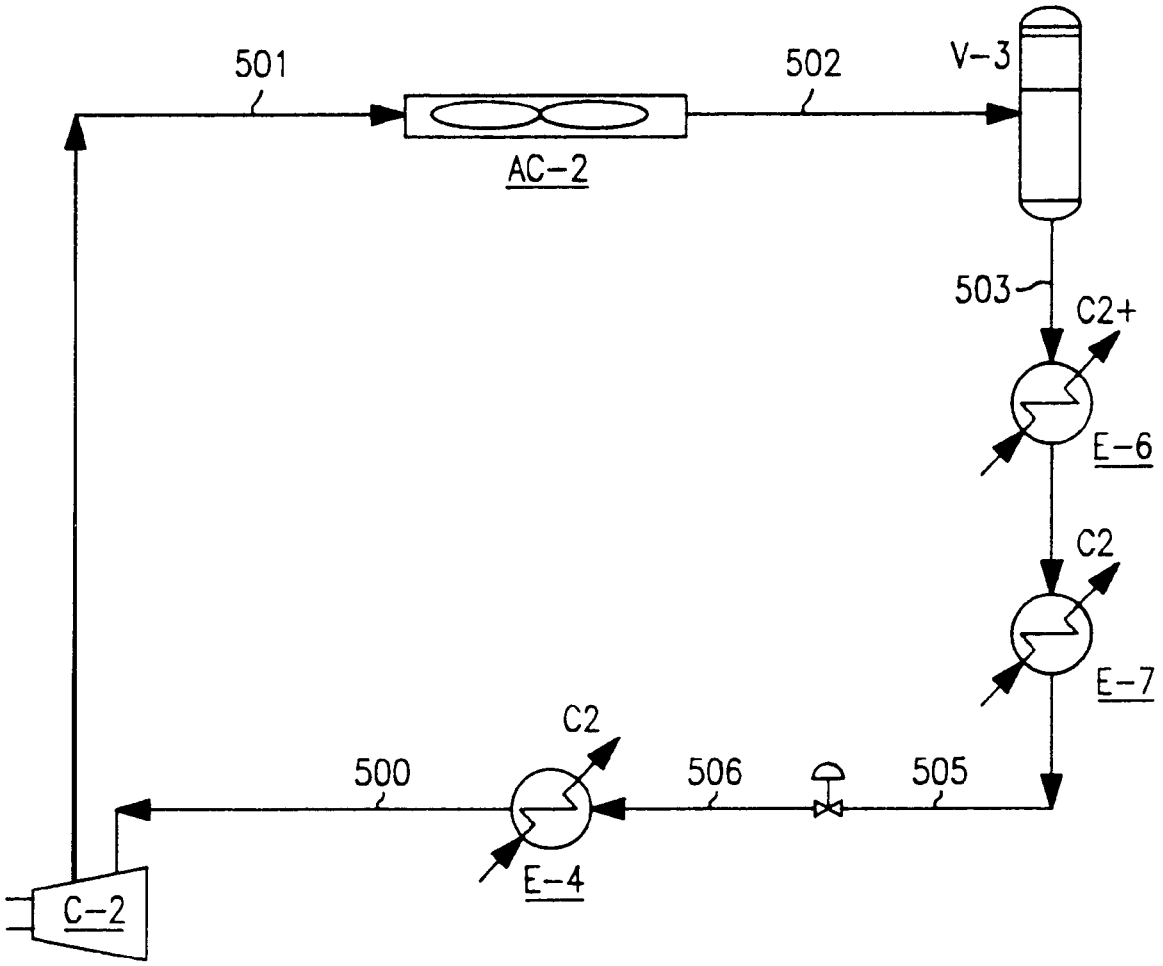
FIG. 2 PRIOR ART
FIG. 2 is a diagram of the propane refrigeration system for the prior art cryogenic turboexpander natural gas plant.

Illustrated in FIG. 2 is the propane refrigeration system providing refrigeration for the deethanizer reflux condenser E-4. This is a simple single stage system with some subcooling. Total propane refrigeration horsepower required is 1,700 HP.

Referring to FIG. 2, 24.4 mmscfd of propane vapor at 45 psig and 24° F. flows from the deethanizer reflux condenser E-4 to the suction of the refrigerant compressor C-2 in stream 500. The propane refrigerant is compressed and then condensed by the propane refrigerant condenser AC-2 in stream 502 at 229 psig and 120° F. The liquid propane is stored in the propane refrigerant accumulator V-3 and then subcooled in stream 505 to 65° F. and 223 psig by heat exchange with cold gas plant streams in E-6 and E-7. The subcooled liquid propane is then flashed to 46 psig and 25° F. and used as refrigerant in E-4, the deethanizer reflux condenser.

EXAMPLE 3

Ethylene Plant(Prior Art)—Main Process

Figure 3:
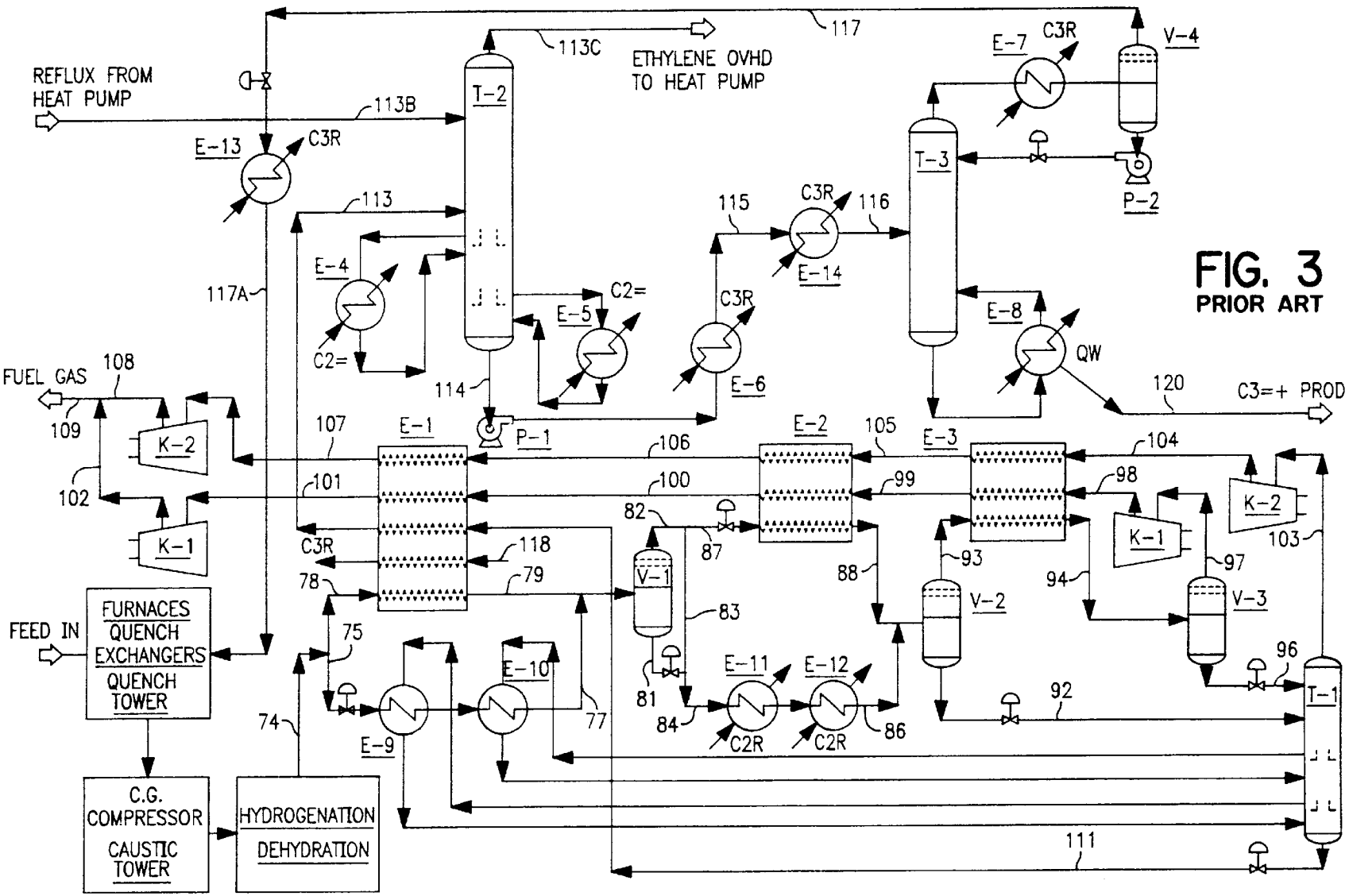
FIG. 3 PRIOR ART
FIG. 3 is a diagram of a prior art conventional ethylene plant.

Illustrated in FIG. 3 is a current prior art representation of a modern ethylene plant. In the following Table 2 are the inlet feed and plant performance specifications for the plant in FIG. 3.

TABLE 2

Ethylene Plant Specifications

| | Lbs/Hr |
|---|---|
| Feedstock | |
| Ethane | 60,537 |
| Propane | 13,998 |
| Butane + | 2,382 |
| TOTAL | 76,917 |
| Plant Products | |
| Ethylene | 54,190 |
| C4 + Product | 9,236 |
| TOTAL | 64,059 |
| Ethylene Disposition | |
| Product | 98.5% |
| Fuel Loss | 1.2% |
| Ethane Recycle | 0.3% |
| Compressor Horsepower Requirements (HP) | |
| Cracked Gas | 12,000 HP |
| Ethylene Refrg. | 4,700 HP |
| Propylene Refrg. | 6,100 HP |
| TOTAL | 22,800 HP |

It should be noted that there are numerous users of ethylene plant technology, each claiming advantage and that FIG. 3 is a general representation of a modern plant. It should also be noted that FIG. 3 is a very simple plant, only producing ethylene and not propylene. It was illustrated this way such that it can be directly compared later to the gas/ethylene plant which is illustrated to be a simple, less capital intensive design for the purpose of disclosure. And finally, the ethylene plant in FIG. 3 starts with the heat exchanger train in front of the demethanizer and omits the front end of the plant including furnaces, quench tower and exchangers, cracked gas compressor, caustic tower, hydrogenation and dehydration.

In the present invention, this part of the plant is the same, except for the cracked gas compressor, so it is omitted for simplicity. In the cracked gas compressor section, the only difference is that in the gas/ethylene plant only three (3) stages are used and only compress to 205 psig versus the four (4) stages and 475–500 psig found in a modern ethylene plant. This represents an approximate 25% reduction in cracked gas compression requirement.

A cracked gas flow of 111,946 lb/hr or 52.5 mmscfd, which has been hydrogenated and dehydrated, enters the demethanizer T-1 heat exchanger train in stream 74 at a pressure of 463 psig and 100° F. The cracked gas is split into streams 78 and 75, with approximately 42.5% or 47,577 lbs/hr of the gas going to stream 75 to provide reboil for the demethanizer T-1. The gas flows through two exchangers, the demethanizer bottom and side reboilers E-9 and E-10 and is chilled to a temperature of −51° F. in stream 77.

The remaining 57.5% or 64,369 lbs/hr of the inlet gas flows to stream 78 and is chilled to a temperature of −68° F. in core exchanger #1 E-1, which is multi-stream, brazed aluminum plate fin heat exchanger. The inlet gas is chilled by heat exchange with four streams: (1) the hydrogen rich fuel gas in stream 100, (2) the methane rich fuel gas in stream 106, (3) propylene refrigeration in stream 118 and (4) the ethylene tower T-2 feed in stream 111. The two inlet gas stream, streams 77 and 79, are now recombined in the Warm Separator V-1 at a combined pressure of 457 psig and −60° F.

The overhead from the warm separator V-1, in stream 82, which contains 38,874 lbs/hr is split into two streams, stream 83 and stream 87. Stream 83, which is approximately 85% of stream 82 or 33,043 lbs/hr, is recombined with the liquid from the warm separator V-1. The combined stream 84, representing 106,115 lbs/hr, passes through two levels of ethylene refrigeration in heat exchangers E-11 and E-12 and is chilled to a temperature of −150° F. in stream 86. The second split, stream 87, which is approximately 15% of stream 82 or 5,831 lbs/hr, passes through core exchanger #2 E-2 and is chilled to temperature of −153° F. through heat exchange with streams 99 and 105. Stream 99 is the hydrogen rich fuel gas and stream 105 is the methane rich fuel gas. The two streams are now recombined in the cold separator V-2 at a temperature of −150° F. and 452 psig.

The majority of the ethylene at this point has been condensed and is flashed from the bottom of the cold separator V-2 into the demethanizer T-1 at a point just above the mid-point of the tower. The flashed stream, stream 92, containing 102,426 lbs/hr enters the tower at a temperature of −149° F. and 150 psig. The overhead from the cold separator V-2, in stream 93, which contains mainly hydrogen and methane, is further chilled to a temperature of −263° F. through heat exchange in core exchanger #3 E-3 with streams 98 and 104. Stream 98 is again the hydrogen rich fuel gas and stream 104 is the methane rich fuel gas. In core exchanger #3 E-3, a majority of the methane in stream 91 and any remaining ethylene is condensed and then separated in the demethanizer reflux separator V-3. The condensed liquid is then flashed into the top of demethanizer T-1 via stream 96 and provides reflux for the tower. Stream 96 consists of 2.25 mmscfd or 4,929 lbs/hr and enters the tower at a temperature of −261° F. and 150 psig.

The overhead from the demethanizer reflux separator V-3 in stream 97, containing hydrogen rich fuel gas, is expanded in the hydrogen turboexpander K-1 to a pressure of 44 psig and −336° F. Stream 98 flow rate is 4,591 lbs/hr or 17.3 mmscfd. This cold gas in stream 98 is then used for refrigeration in core exchangers #1, 2 and 3 and exits the core exchanger #3 E-1 in stream 101 at a temperature of 89° F. and 39 psig. This gas is then compressed in the hydrogen booster compressor K-1, which is directly linked to hydrogen expander K-1, to a pressure of 60 psig and 159° F. and goes to the fuel system.

The gas from the top of the demethanizer T-1 in stream 103, at 150 psig and −167° F., is expanded in the methane turboexpander K-2 to a pressure of 50 psig and −204° F. Stream 104 represents 9,596 lbs/hr or 5.8 mmscfd and is also used for refrigeration in core exchangers #1,2 and 3 before exiting in stream 107 at 89° F. and 45 psig. This gas is then compressed in the methane booster compressor K-2, which is directly linked to the methane turboexpander K-2, to a pressure of 62 psig and 131° F. The two fuel gas streams, streams 102 and 108, are now combined into a single fuel gas stream containing 23 mmscfd in stream 109 at a pressure of 60 psig.

In the demethanizer T-1, the ethylene is demethanized to a level of no greater than 120 parts per million by volume of methane in the ethylene. Reboil heat for the demethanizer T-1 comes from heat exchange with inlet cracked gas, which in turn provides chilling for the inlet gas in heat exchangers E-9 and E-10. The ethylene rich product leaves the bottom of the demethanizer T-1 at a temperature of −40° F. and a 150 psig and is then flashed to the ethylene tower T-2 pressure in stream 111 at 74 psig and −73° F. The flashed feed is then used for refrigeration in core exchanger #1 E-1 and exists the exchanger and enters the ethylene tower T-2 at a pressure of 68 psig and −76° F. in stream 113.

Figure 4:
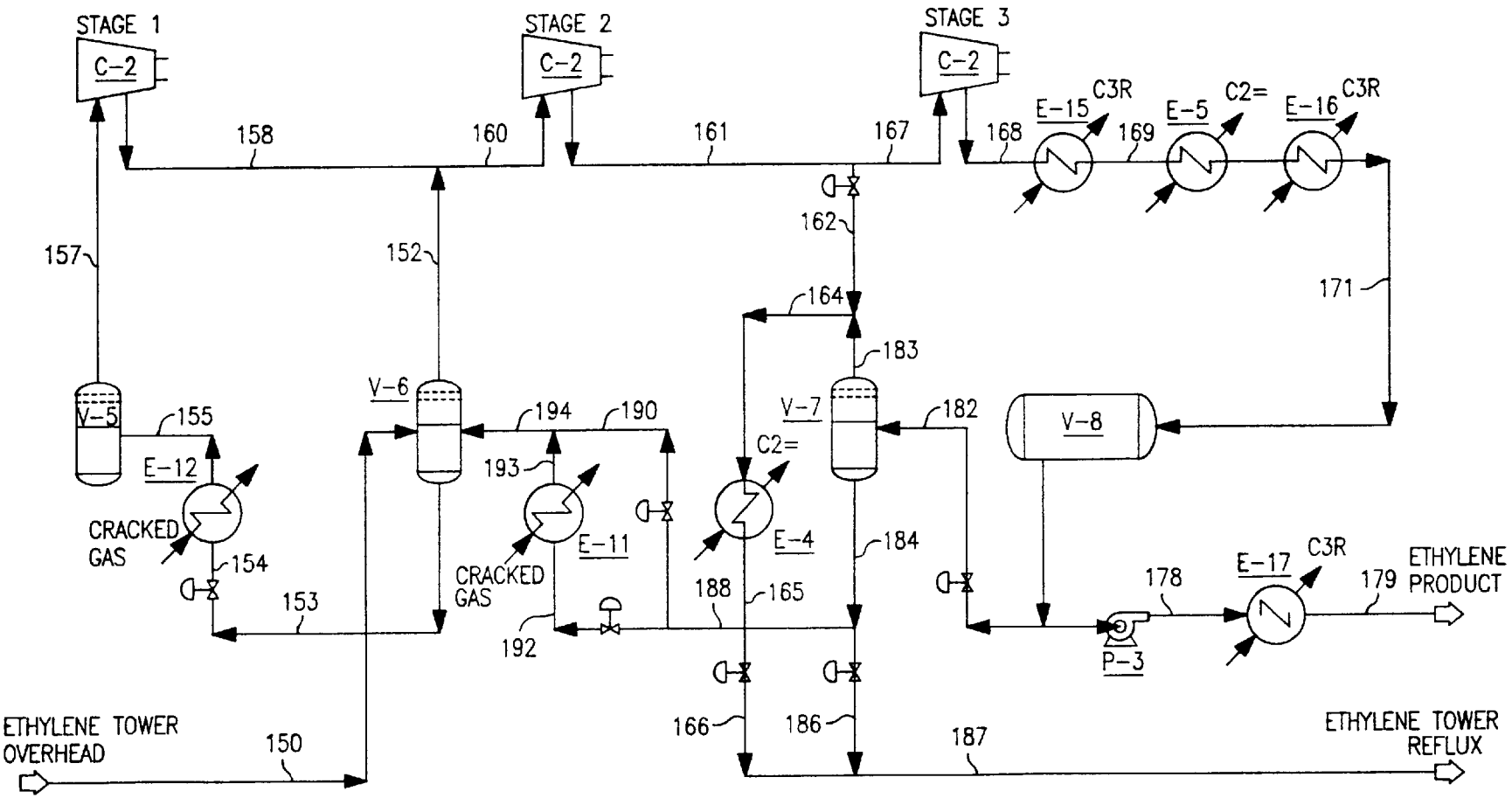
FIG. 4 PRIOR ART
FIG. 4 is a diagram of the combined ethylene refrigeration-heat pump system for the prior art ethylene plant.

In the ethylene tower T-2, the ethylene is purified to a specification of no greater than 80 parts per million by volume of ethane in the ethylene. Refrigeration for the condenser and reboil heat for the reboilers are all provided by an ethylene heat pump which is combined into a single ethylene refrigeration compressor. The ethylene tower side reboiler E-4 and the ethylene tower bottom reboiler E-5 are all part of the ethylene heat pump/refrigeration system. This system is shown in FIG. 4 and discussed later in a following section "Ethylene Plant—Ethylene Refrigeration System."

Coming off the bottom of the ethylene tower T-2 is an ethane plus mixture in stream 114 at a pressure of 70 psig and −48° F. This stream, consisting of 11.9 mmscfd or 43,543 lbs/hr, is then pumped up to pressure 115 psig and refrigeration is recovered in propylene refrigeration subcooler #1 E-6 and propylene refrigeration subcooler #2 E-14. Stream 116 enters the deethanizer T-3 just above the mid-point of the tower at a pressure of 110 psig and −4° F. Coming off the top of the deethanizer T-3 is a vaporous ethane mixture in stream 117 at a pressure of 109 psig and −32° F. Refrigeration is recovered from this stream in the propylene refrigeration subcooler #3 E-13 and then the 10.3 mmscfd or 34,290 lbs/hr of ethane gas is recycled as feed to the cracking furnaces. Coming off the bottom of the deethanizer T-3 is a propylene plus mixture at a temperature of 100° F. and 110 psig. This propylene plus product in stream 120, containing 1.5 mmscfd or 9,256 lbs/hr, can be further fractionated, recycled or sold as a plant product.

EXAMPLE 4

Ethylene Plant (Prior Art) Ethylene Refrigeration System

Figure 5:
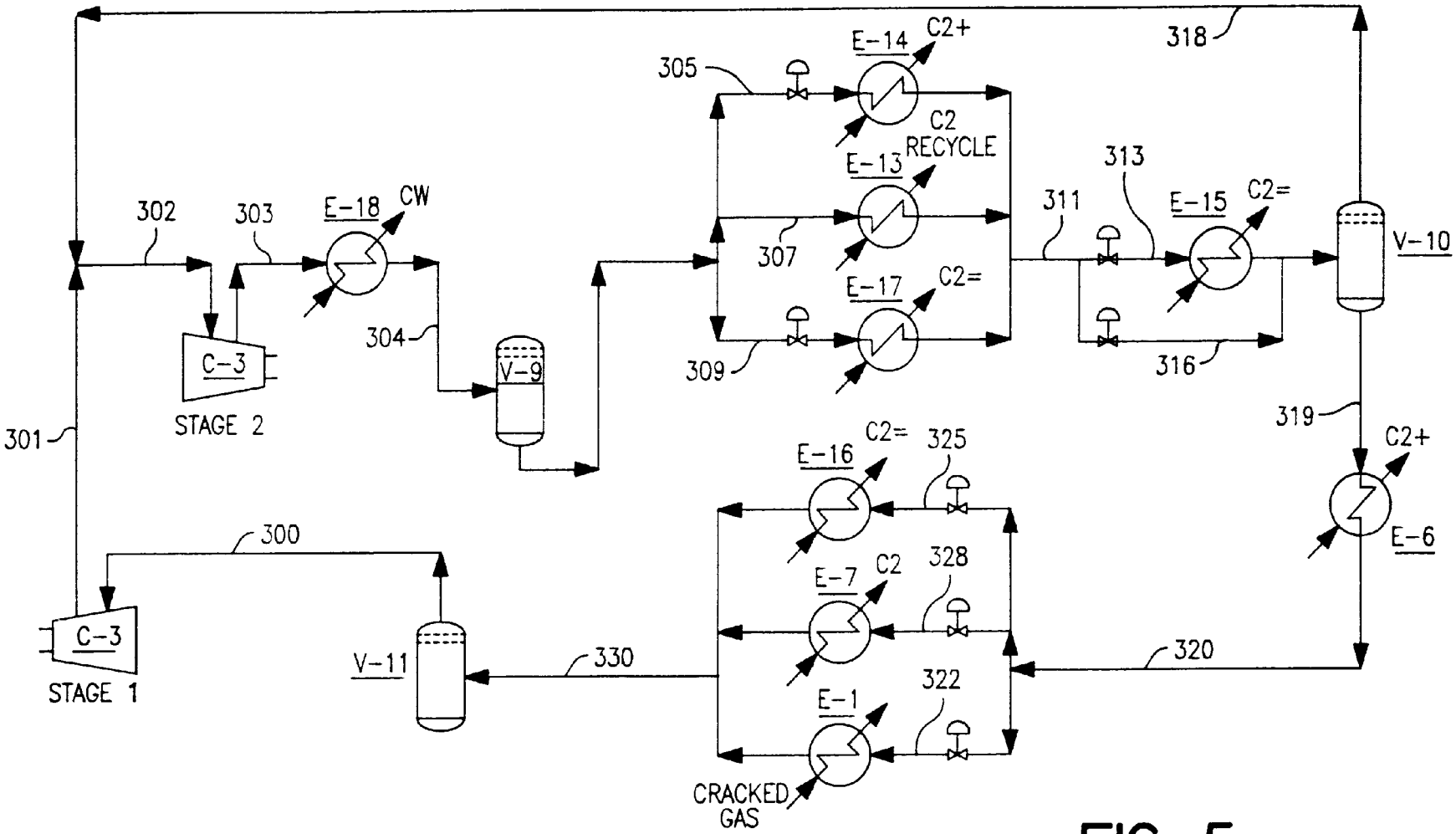
FIG. 5 is a diagram of the propylene refrigeration system for the prior art ethylene plant.

Presented in FIG. 4 and in FIG. 5 are the combined ethylene tower heat pump/ethylene refrigeration system and the propylene refrigeration system required for a prior art ethylene plant. These systems are complicated and expensive. This is important since later it will be demonstrated that in accordance with the present invention it is possible to eliminate the ethylene refrigeration system and to greatly reduce the size of the propylene system.

Referring to FIG. 4, the ethylene refrigeration and the ethylene tower heat pump have been combined into one system. Gaseous ethylene at a flow rate of 70.7 mmscfd or 217,786 lbs/hr comes off of the top of the ethylene tower T-2 and enters the heat pump/refrigeration system in stream 150 at a pressure of 60 psig and −94° F. There it is combined in the stage 2 suction drum V-6 with stream 194. Stream 194 contains the gaseous ethylene coming from E-11, a kettle type heat exchanger which is providing −95° F. level refrigeration to the main process (See FIG. 3) and ethylene refrigerant in stream 190 which has been flashed to the −95° F. pressure.

The liquid off the bottom of the stage 2 suction drum V-6 in stream 153, 11.4 mmscfd or 35,221 lbs/hr, is now flashed to 1 psig and −153° F. to provide the low level refrigeration required in ethylene chiller #2 E-12. E-12 is the kettle type heat exchanger that produces the −150° F. level refrigeration used in the ethylene plant process (See FIG. 3). Gaseous ethylene comes off the top of the E-12 kettle exchanger and flows to the suction of the first stage of the ethylene refrigerant compressor C-2 at a pressure of approximately 0.5 psig and −154° F. in stream 157.

In stage 1 of the ethylene refrigerant compressor C-2, the ethylene is compressed to a pressure of 60 psig and 11° F. in stream 158. Here it is combined with the overhead from the stage 2 suction drum V-6 in stream 152 containing approximately 80 mmscfd or 246,540 lbs/hr of gaseous ethylene. The combined stream, stream 160, at 60 psig and −81° F. is the suction for the second stage of the ethylene refrigerant compressor C-2. In the second stage of the compressor, the gas is compressed to a pressure of 113 psig and −20° F. in stream 161.

Stream 161 is now split into streams 162 and 167. Stream 162, representing only 20% of stream 161 or 18.7 mmscfd, is combined with stream 183 which is the overhead from the stage 3 suction drum V-7. The combined stream, stream 164, containing 26.3 MMSCFD or 81,057 lbs/hr at −35° F., now flows to the ethylene tower side reboiler E-4 and is condensed while providing heat into the ethylene tower T-2. Stream 167, containing the rest of stream 161 or approximately 73 mmscfd or 224,163 lbs/hr, is the suction for the third stage of the ethylene refrigerant compressor C-2.

The gas exits the third stage in stream 168 at a pressure of 218 psig and 56° F. and next flows to the desuperheater E-15. In the desuperheater E-15, the ethylene is chilled in stream 169. The chilled gas is now partially condensed in the ethylene tower bottom reboiler E-5 providing heat into the ethylene tower T-2 and then totally condensed in the ethylene condenser E-16 using propylene refrigeration. The condensed ethylene in stream 174, consisting of 73 mmscfd at 212 psig and −36° F. now flows to the ethylene accumulator V-8.

Liquid ethylene comes off the bottom of the ethylene accumulator V-8 and is split into streams 178 and 182. Stream 178, which contains 17.6 mmscfd or 54,214 lbs/hr, is the ethylene product which is then pumped to the delivery pressure of 500 psig in stream 179. Before exiting the plant, refrigeration is recovered from the ethylene product in propylene refrigeration subcooler #4 E-17.

The remaining 76% of the flow from the ethylene accumulator V-8 or 55 mmscfd and 169,949 lbs/hr is flashed into the stage 3 suction drum V-7 via stream 182. Pressure and temperature of stream 182 is 110 psig and −69° F. The vapor off the top of the stage 3 suction drum V-7 in stream 183 is next combined with a portion of the vapor coming from the discharge of the second stage of the ethylene compressor as described earlier to be condensed in the ethylene tower side reboiler E-4.

The liquid ethylene off the bottom of the stage 3 suction drum in stream 184 is now split into streams 186 and 188. Approximately 56% of stream 184 containing 27 mmscfd or 82,514 lbs/hr goes to stream 186. This stream, which has been flashed to the ethylene tower T-2 pressure, is combined with stream 166 in stream 187 to produce the required ethylene tower T-2 reflux. Stream 166 is the ethylene vapor that has been condensed in the ethylene tower side reboiler E-4 and then flashed to ethylene tower T-2 pressure. Total ethylene tower T-2 reflux is 53 mmscfd or 163,571 lbs/hr at 60 psig and −94° F. The remaining 44% or 21 mmscfd of stream 184 flows to stream 188.

Stream 188 is now split into streams 190 and 192. Approximately 38% or 8 mmscfd of stream 188 goes to stream 192 which is flashed to 60 psig and −95° F. and used as refrigeration in the ethylene plant process in ethylene chiller #1 E-11. Stream 190, containing 12.5 mmscfd or 38,560 lbs/hr, is flashed into V-6, the stage 2 suction drum, at a pressure of 60 psig and −95° F. This completes the ethylene heat pump/refrigeration system.

EXAMPLE 5

Ethylene Plant (Prior Art)—Propylene Refrigeration System

Illustrated in FIG. 5, is a simplified propylene refrigeration system for a typical modern ethylene plant. Total propylene refrigeration compression required is 6,100 HP. Most modern ethylene plants have 3 to 4 stages in the propylene refrigeration system for improved efficiency, we have limited our propylene system to 2 stages. For an accurate comparison, the propane refrigeration system in the gas/ethylene plant will also be limited to 2 stages.

Referring to FIG. 5, 37.7 mmscfd of gaseous propylene in stream 300 at 1.5 psig and −49° flows from the suction scrubber V-11 to the first stage of the refrigerant compressor C-3 and compressed to 31 psig and 41° F. in stream 301. This gas is then combined with the economizer V-10 gas in stream 318 and compressed to 215 psig and 185° F. in stream 303. The combined gas consisting of 48.4 mmscfd is then condensed using cooling water in the propylene refrigerant condenser E-18. The condensed propylene liquid at 212 psig and 100° F. is then stored in the propylene refrigerant accumulator V-9 before flowing to three subcoolers, E-14, E-13, and E-17. In the subcoolers, the propylene refrigerant is subcooled by several cold ethylene plant streams to 31° F. and 209 psig in stream 311. Stream 311 is next split with 6.4 mmscfd being flashed to 31 psig and −1° F. in stream 313 and used as refrigerant in E-15, the ethylene refrigerant desuperheater. The remaining 42 mmscfd in stream 316 is flashed to the economizer V-10 where it is recombined with the gaseous propylene coming from E-15.

Liquid propylene in stream 319 consisting of 37.7 mmscfd at 31 psig and −2° F. is now further subcooled in stream 320 to −21° F. and 28 psig in E-6 by heat exchange with the ethylene plant deethanizer feed. The subcooled propylene liquid in stream 320 is now flashed in streams 325, 328, and 322 to 2 psig and −48° F. and used as refrigerant in the ethylene refrigerant condenser E-16, the deethanizer reflux condenser E-7, and the cracked gas chiller E-1.

EXAMPLE 6

Figure 6:
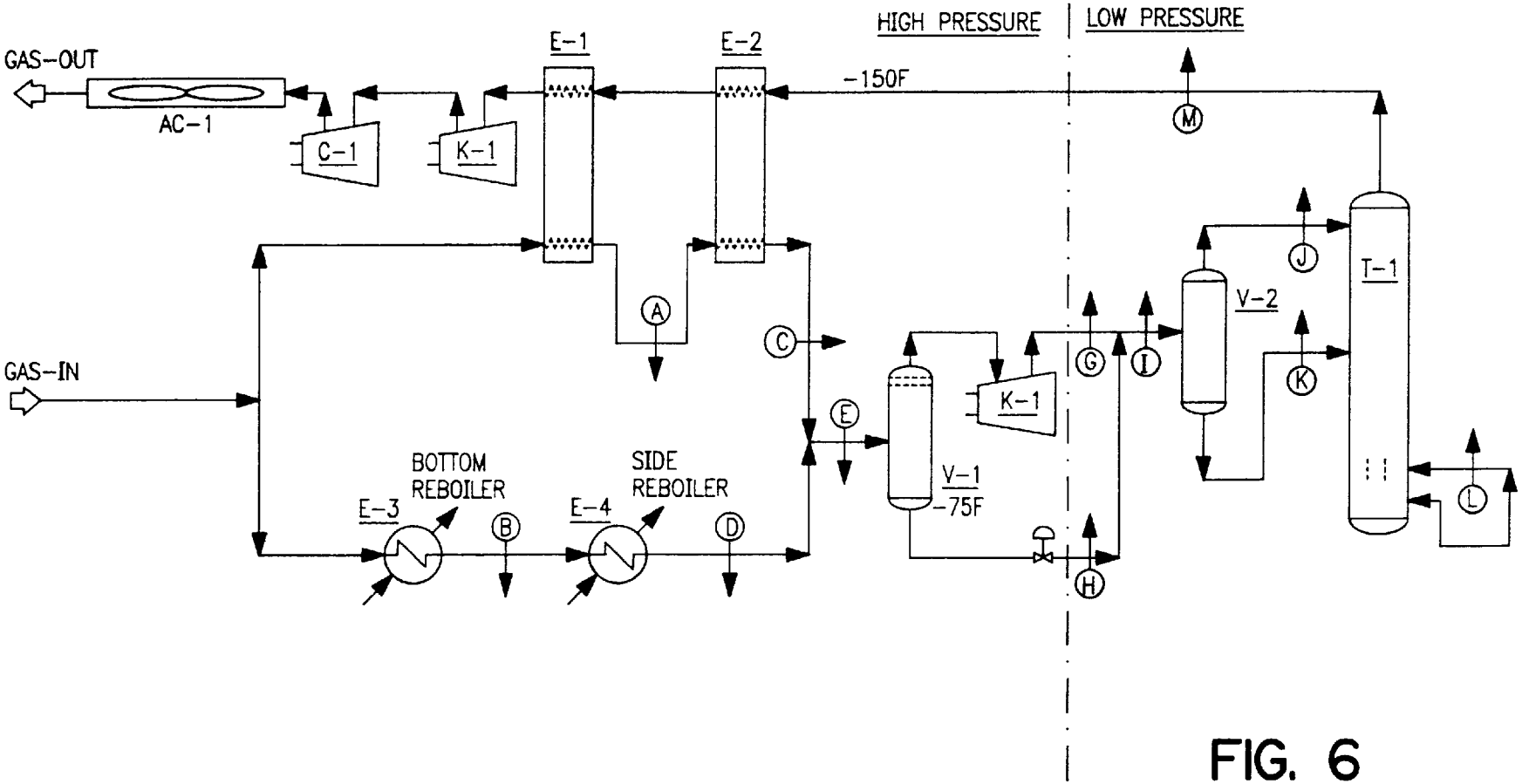
FIG. 6 is a diagram of a natural gas processing plant used as a methane refrigeration system including refrigeration points into and out of the gas plant.

Example 6 provides a simplified explanation of a first embodiment of the present invention of how and from where a cryogenic natural gas plant produces ethylene level refrigeration. Referring to FIG. 6 a conventional cryogenic turboexpander gas plant is illustrated. The plant has a high and low pressure side, with the high pressure side basically constituting everything upstream of the cold separator V-1. High pressure inlet gas is chilled by heat exchange with returning cold demethanizer overhead plant residue gas (−150° F.) in gas/gas exchangers E-1 and E-2 and demethanizer bottom and side reboilers E-3 and E-4. The chilled gas (−75° F.) is separated in the cold separator V-1. Then the V-1 overhead gas is expanded through the turboexpander K-1 into the turboexpander discharge separator V-2. The V-2 overhead vapor enters the demethanizer T-1 top section and the bottom liquid is also flashed into the demethanizer T-1. The refrigeration for the process comes from the large internal methane content in the natural gas that is expanded through the turboexpander producing work in the turboexpander driven booster compressor K-1 and thus producing refrigeration into the process. It is this chilling of the high pressure plant inlet gas and then expansion to a lower pressure through a turboexpander that produces the ethylene level refrigeration/temperature required for a high ethane recovery in the gas plant demethanizer.

Now to produce ethylene level refrigeration for use in the ethylene plant, for purpose of disclosure in the example above, note that −150° F. demethanizer overhead residue gas is used to chill the cold separator V-1 feed to −75° F. The −150° F. level refrigeration is not required to chill the cold separator feed to −75° F. and could be replaced by a warmer level of refrigeration if available. In short, this is how ethylene level refrigeration is produced for ethylene processing, ethylene level refrigeration on the cold low pressure side of the gas plant is extracted for use in the ethylene plant and replaced with enough warmer level refrigeration on the higher pressure side of the gas plant to maintain the desired gas plant product recoveries.

Referring again to FIG. 6, five (5) points labeled A through E, have been identified where refrigeration can be added to the high pressure inlet gas. Points A and B are similar and the most common places to add refrigeration. The refrigeration here is at a level from 30° F. to −40° F. and possible sources of refrigeration include: (1) low pressure gas plant NGL product, (2) ethylene tower bottom liquid, (3) propane or propylene mechanical refrigeration and (4) other internal gas plant or ethylene plant streams. It is important to note here that little or no mechanical propane or propylene refrigeration is required since there are several internal streams available which can provide the necessary refrigeration through heat exchange. This is an important advantage and is derived from combining components of gas and ethylene processing which makes available a low pressure gas plant NGL product and an ethylene tower bottom liquid which can be used at these points to provide the necessary refrigeration.

Points C, D, and E are also similar and represent places where a colder level of refrigeration from −50° F. to −100° F. can be added. Potential internal and external refrigeration sources which are set forth in FIG. 6 include: (1) external ethane or ethylene mechanical refrigeration, (2) ethylene tower feed, (3) ethylene tower bottom and/or side reboil streams and (4) other internal gas plant and ethylene plant streams.

After refrigeration has been added to the high pressure side of the gas plant in points A through E, ethylene level refrigeration can now be taken from points G through M for use in ethylene processing. The internal ethylene level refrigeration available in points G through M, −100° F. to −160° F., can now be used in (1) the ethylene plant demethanizer heat exchanger train, (2) to condense ethylene plant ethylene tower reflux and/or product or (3) used in other ethylene processing locations.

EXAMPLE 7

Figure 7:
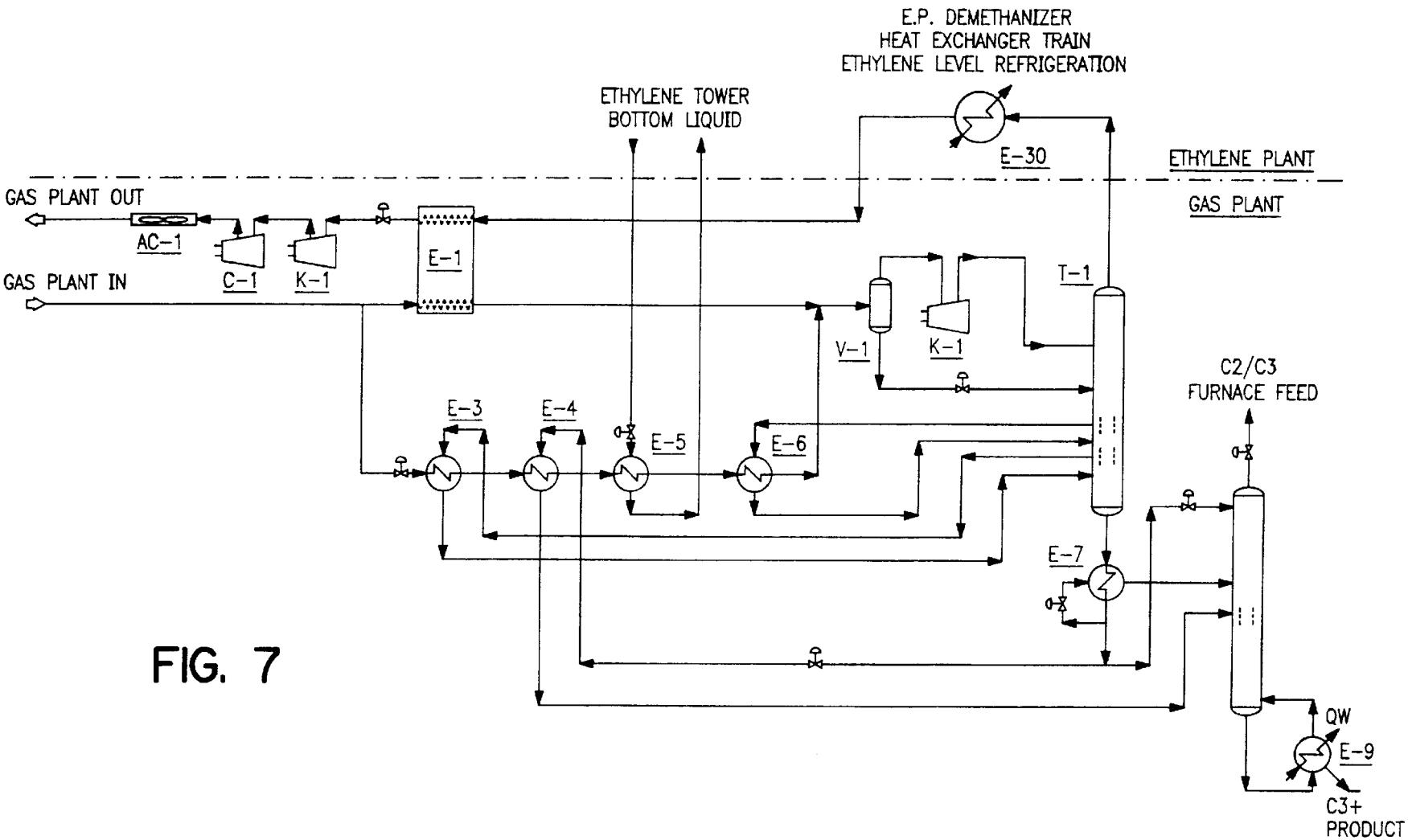
FIG. 7 is a diagram of an embodiment of the present invention wherein a gas plant methane refrigeration system is used to replace mechanical ethylene refrigeration in the ethylene plant demethanizer heat exchanger train.

An example according to the present invention of how ethylene level refrigeration is produced in a cryogenic gas plant for use in the ethylene processing demethanizer heat exchanger train is presented in FIG. 7, which represents a standard cryogenic turboexpander plant capable of 65% to 75% ethane recovery and not one of the more modern refluxing types capable of 90+% ethane recovery. Here −150° F. level refrigeration is produced for the ethylene plant in exchanger E-30. The ethylene level refrigeration used in the ethylene plant is replaced in the gas plant high pressure side in E-3, a G.P. product exchanger (−15° F.) and E-4, an ethylene tower bottom liquid exchanger (−30° F.). (Note that T-2, the gas plant deethanizer is run at 110 psig.)

EXAMPLE 8

The second embodiment of the invention is really an extension of the first embodiment to use the cryogenic gas plant methane refrigeration system to provide ethylene level refrigeration in ethylene processing. Here refrigeration is placed on the high pressure side of the gas plant in the form of ethylene tower bottom and/or side reboil stream and colder refrigeration is recovered from the low pressure side of the gas plant to condense reflux and/or product from the ethylene tower overhead stream. In essence, the ethylene tower heat pump is placed onto the gas plant methane refrigeration system.

Figure 8:
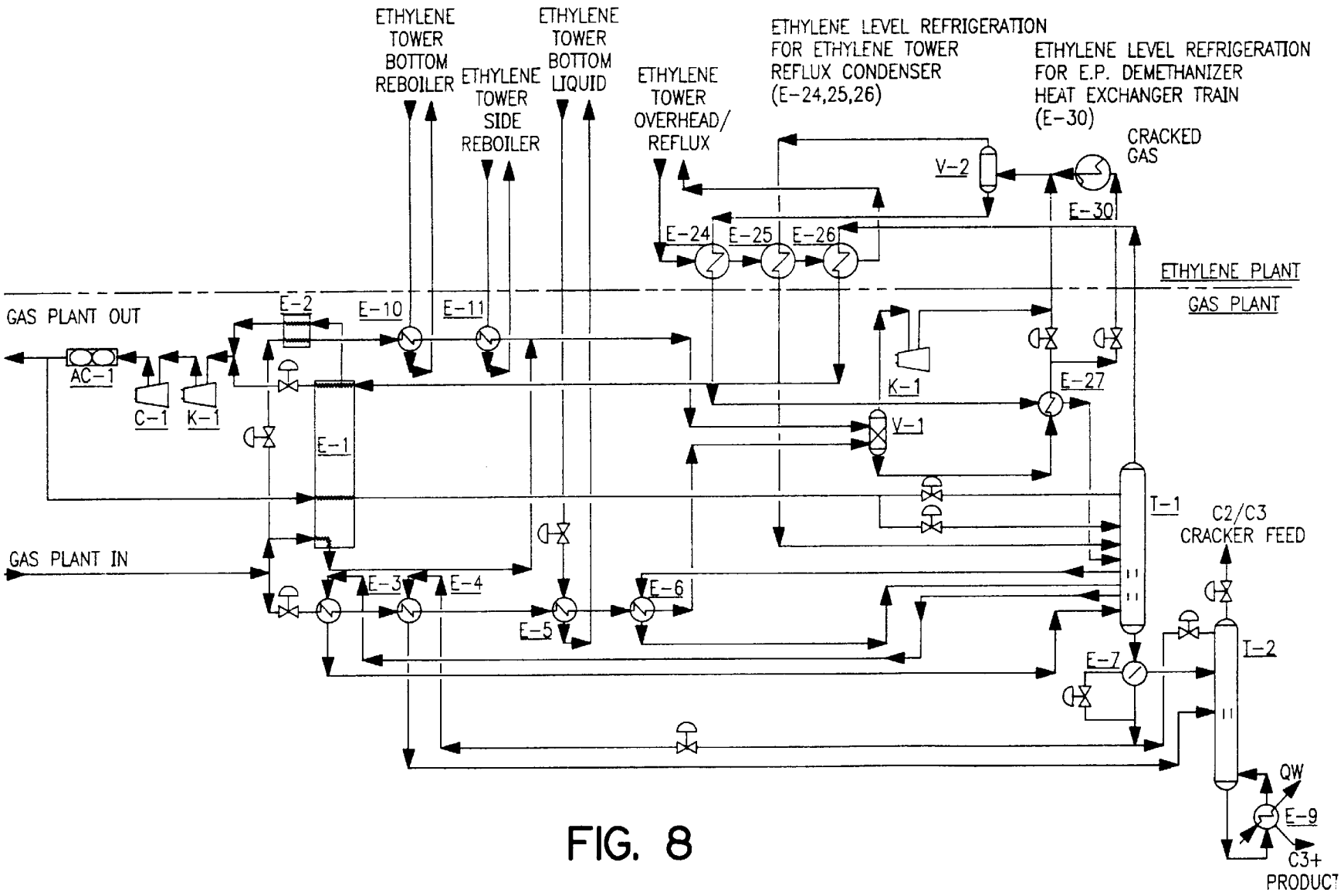
FIG. 8 is a diagram of another embodiment of the invention wherein the gas plant methane refrigeration system is used to replace the mechanical ethylene refrigeration in the ethylene plant demethanizer heat exchanger train and in the ethylene tower condenser.

FIG. 8 illustrates an example of combining embodiments 1 and 2 of the invention, that is to use the gas plant to provide ethylene level refrigeration for the ethylene plant demethanizer heat exchanger train and to provide ethylene level refrigeration for the ethylene tower condenser. The gas plant in FIG. 3B is a more modern refluxing type capable of 90+% ethane recovery. As in FIG. 3A, refrigeration in the form of low pressure gas plant NGL product and ethylene tower bottom liquid, is positioned on the high pressure inlet gas in the bottom reboil split for the demethanizer in exchangers E-3 and E-4. What is added is the ethylene tower side and bottom reboilers in exchangers E-10 and E-11 on the upper high pressure gas split flowing to the gas/gas exchanger in the gas plant.

Also different from FIG. 7 is the addition of some packing in the gas plant cold separator, thus we now call it a rectifier V-1. When adding the ethylene tower reboil stream on the top gas/gas split, this inlet gas plant stream is greatly condensed and is much colder than the exiting gas plant bottom reboiler split. Consequently, the packing provides a greater separation of methane over the top to the turboexpander K-1 versus just a separator which in turn produces more work/refrigeration from the turbo expander. Another difference is where the ethylene level refrigeration comes from for the ethylene plant heat exchanger train, In FIG. 3A, the refrigeration came from the gas plant demethanizer overhead stream, in FIG. 8, it comes from subcooled rectifier V-1 bottom liquids.

To provide the ethylene level refrigeration for the ethylene tower condenser, three (3) exchangers are used in series. The first two exchangers contain the bottom liquid and overhead gas from the expander discharge separator V-2 and work together to partially condense the ethylene tower overhead. Flowing into the expander discharge separator V-2 are the turboexpander K-1 discharge, the rectifier V-1 bottom liquid after heat exchange in E-30, and the remaining rectifier V-1 bottom liquids not required in E-30. The expander discharge separator V-2 is required in order to use a plate-fin exchanger for E-24, E-25 and E-26 which requires that we not have mix phase streams. The final exchanger, E-26, uses demethanizer T-1 overhead gas to completely condense and subcool the ethylene tower overhead.

EXAMPLE 9

The third embodiment of the invention that creates the advantages seen in the gas/ethylene plant is to use liquid methane from the gas plant to reflux the ethylene plant demethanizer. To understand the tremendous advantage this creates, it is helpful to review current ethylene plant technology and the reasons for compressing the inlet cracked gas up to 475 to 500 psig. Essentially the pressure is required for two reasons: (1) to be able to condense a majority of the ethylene before entering the demethanizer using cascade ethylene refrigeration and (2) to be able to create enough methane reflux for the demethanizer. Both of these are tied together in that this is what is required to get high ethylene recoveries. If the pressure were to be lowered, then less ethylene would be condensed and less methane reflux would be created resulting in significant losses of ethylene into the fuel gas.

In a high ethane recovery cryogenic gas plant of the prior art, a large quantity of residue gas, which is almost pure methane, is used to reflux the gas plant demethanizer. Referring back to FIG. 1, the gas plant example, 150 mmscfd of residue gas is condensed at 792 psig and −148° F. to be used as gas plant demethanizer reflux. To make reflux for the ethylene plant demethanizer in the gas/ethylene plant, a small percentage of the 150 mmscfd of reflux is used in the gas plant. The ethylene plant demethanizer only requires 7.5 mmscfd or 5% of the 150 mmscfd. The 7.5 mmscfd is flashed to the ethylene plant demethanizer pressure of 50 psig and −240° F. This provides the reflux and the refrigeration required to theoretically recover 100% of the ethylene having only compressed the inlet cracked gas to a pressure of 205 psig. In theory, the inlet cracked gas pressure could be as low as the pressure required to maintain fuel gas pressure or approximately 120 psig and still recover 100% of the ethylene. The disadvantage here is that more methane reflux is required and more ethylene level refrigeration from the gas plant is required in the ethylene plant demethanizer heat exchanger train thus reducing the ethylene producing capacity of the plant.

Figure 9:
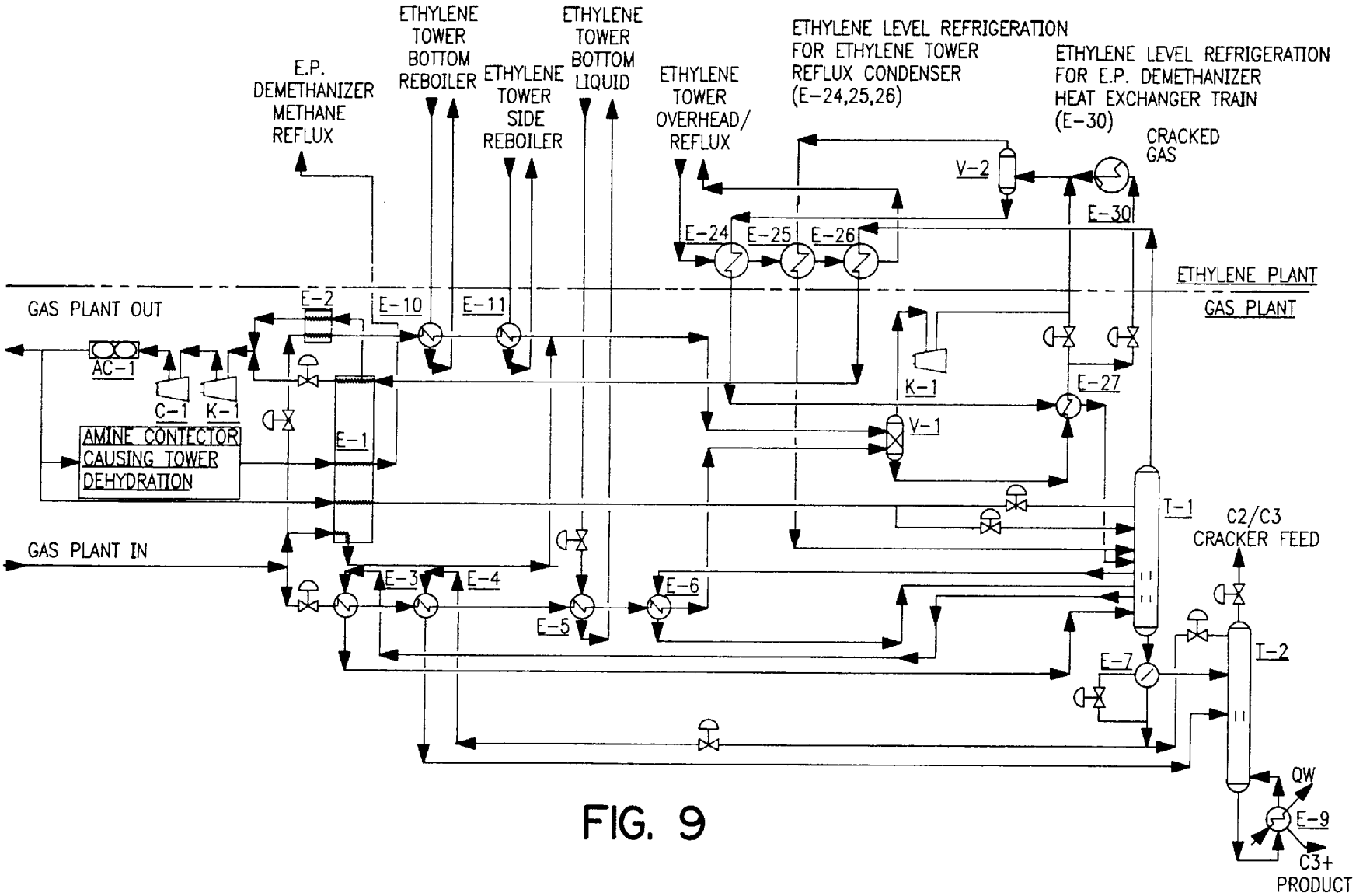
FIG. 9 is a diagram wherein the gas plant methane refrigeration system is used to replace the mechanical ethylene refrigeration in the ethylene plant demethanizer heat exchanger train and in the ethylene tower condenser, and methane reflux is taken from the gas plant to reflux the ethylene plant demethanizer.
Figure 10A:
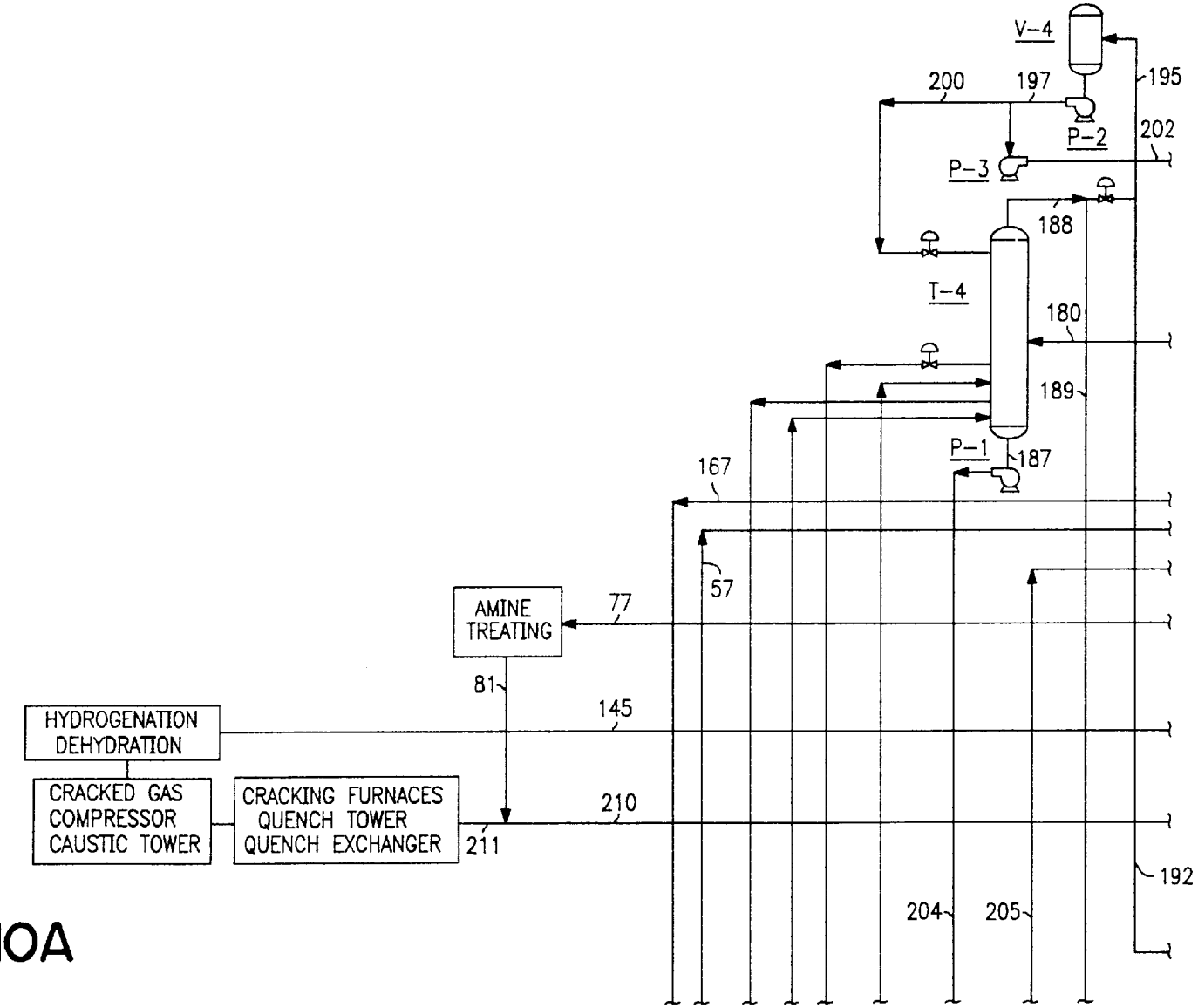
FIG. 10 is a diagram of the present invention utilizing a combination of all of the foregoing embodiments of the invention.
Figure 10B:
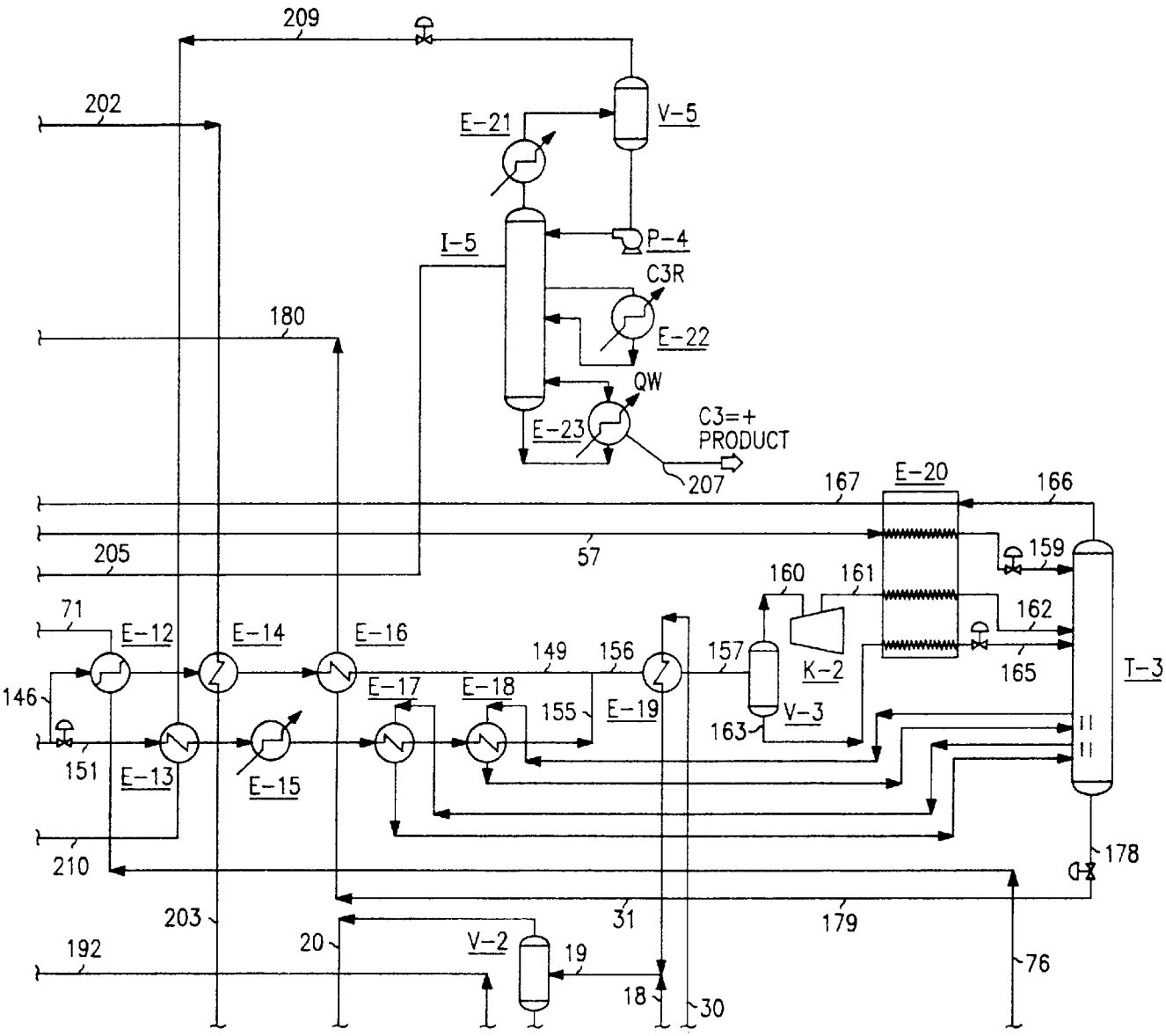
Figure 10C:
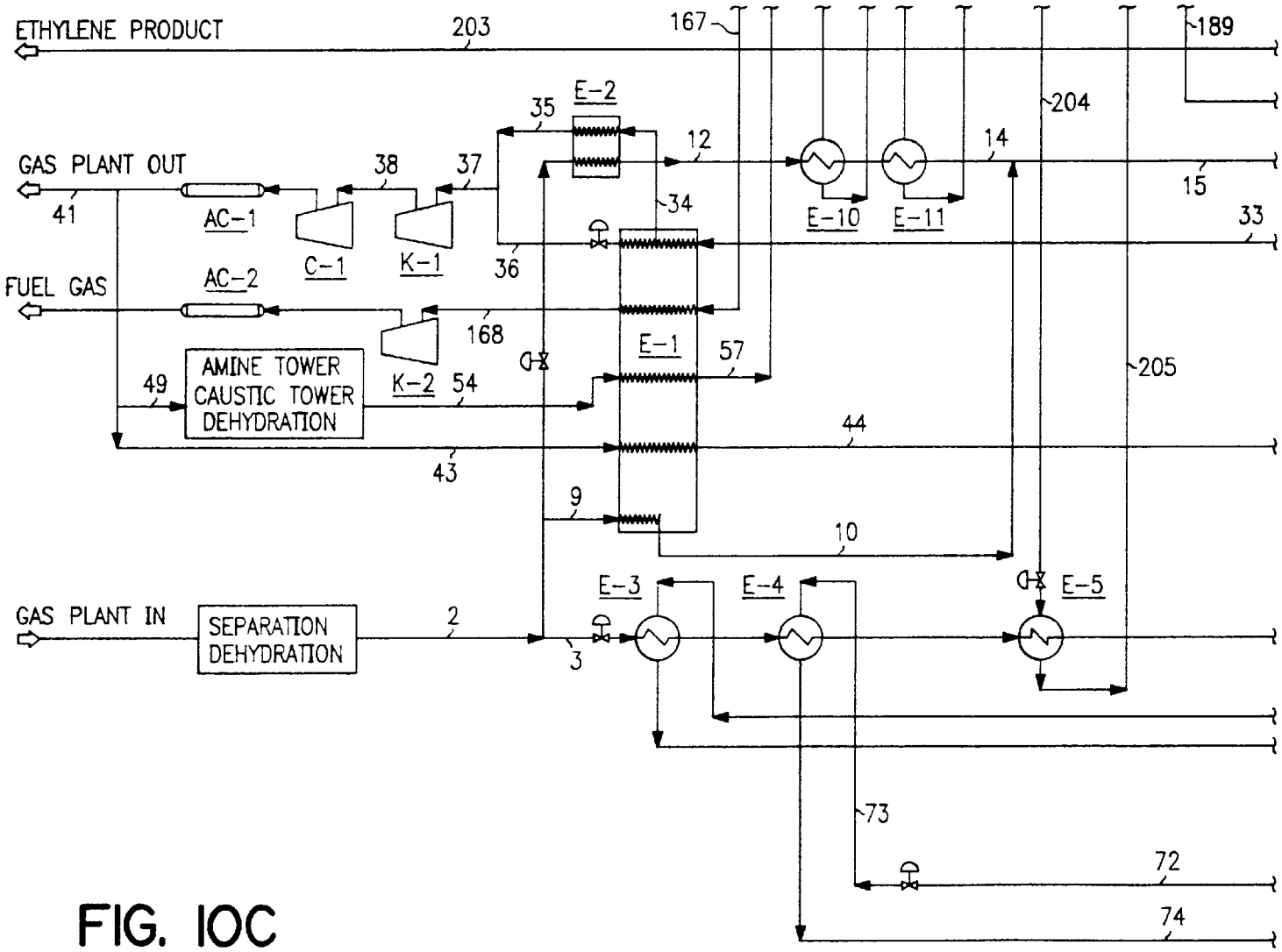
Figure 10D:
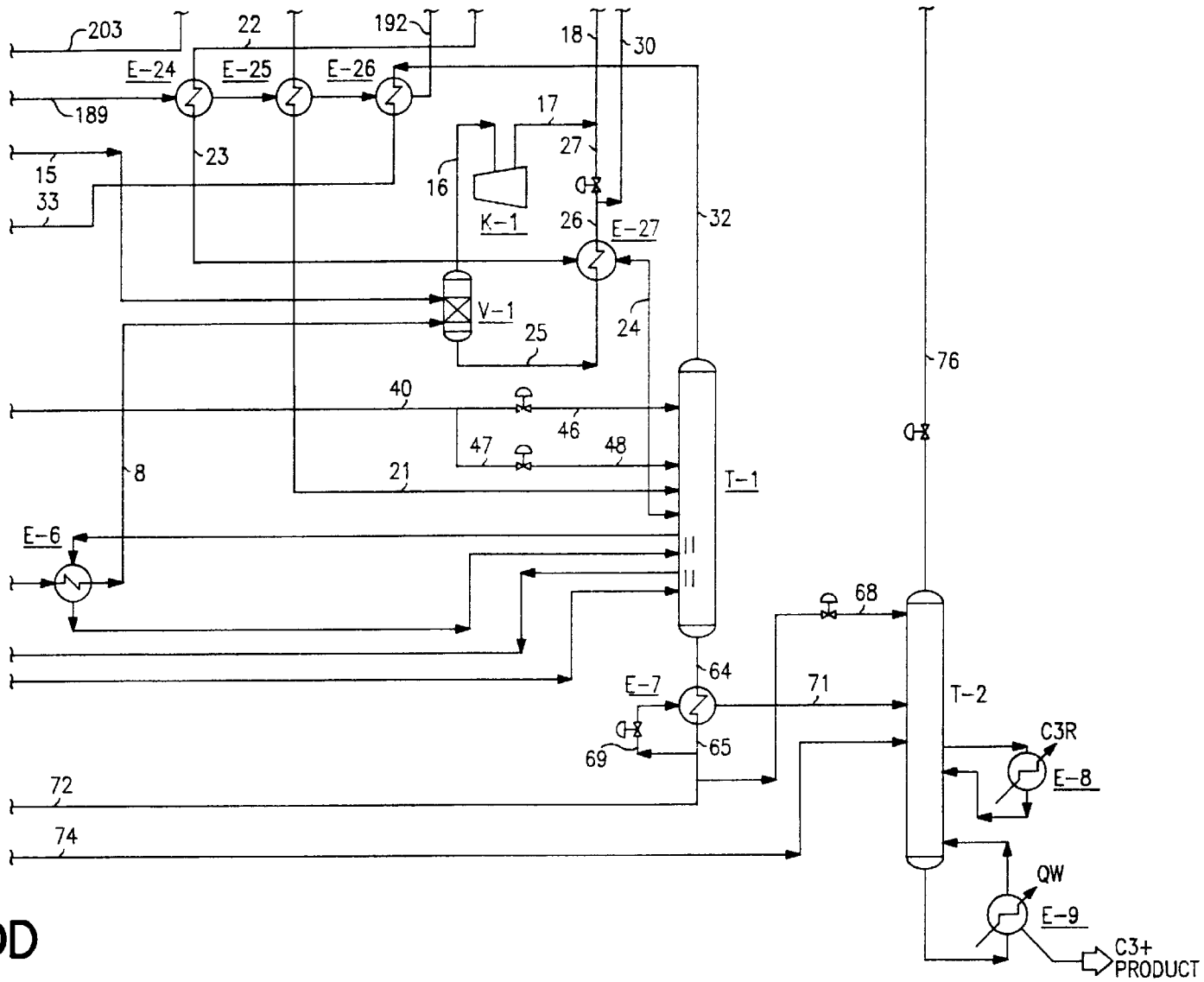

Illustrated in FIG. 9 is an example of a gas/ethylene plant where methane is taken off the gas plant to reflux the ethylene plant demethanizer. FIG. 9 is also an example of a plant where the foregoing three embodiments of the invention are used including: (1) using cryogenic gas plant ethylene level refrigeration in the ethylene plant demethanizer heat exchanger train, (2) using cryogenic gas plant ethylene level refrigeration to condense ethylene tower reflux and/or product and (3) using gas plant methane to reflux the ethylene plant demethanizer. FIG. 9 is essentially FIG. 8 with the addition of a small methane stream coming off the gas plant residue. This stream passes through an amine contactor and a caustic tower for $CO_2$ and $H_2S$ removal and then is dehydrated using mole sieve before being condensed in E-1, the gas plant reflux exchanger.

From E-1, the now liquid methane is directed to the ethylene plant demethanizer as reflux.

EXAMPLE 10

Illustrated in FIG. 10 is a combination of all three embodiments of the invention. The Gas/Ethylene plant processing inlet conditions and performance specifications are given in Table 3. In this example and from here on ("G.P.") represents Gas Plant and ("E.P.") represents Ethylene Plant.

TABLE 3

| Gas/Ethylene Plant Basis/Specifications | | |
|---|---|---|
| GAS PLANT | | |
| Inlet Flow (mmscfd) | | 400 |
| Inlet Pressure (psig) | | 800 |
| Outlet Pressure (psig) | | 800 |
| Inlet Temperature (° F.) | | 80 |
| Composition | Mol % | Rec % |
| Methane | 91.75% | — |
| $CO_2$ | 0.47% | — |
| Ethane | 4.62% | 99.5% |
| Propane | 1.75% | 100% |
| Butane + | 1.39% | 100% |
| Recompressor (HP) | | 27,400 |
| ETHYLENE PLANT | | |
| Feedstock (lbs/hr) | | |
| Ethane | | 60,537 |
| Propane | | 13,998 |
| Butane + | | 2,382 |
| Total | | 76,917 |
| Plant Products (lbs/hr) | | |
| Ethylene | | 54,921 |
| C3 + Product | | 9,129 |
| Total | | 64,050 |
| Ethylene Specs. (PPM by Vol) | | |
| Methane | | 35 |
| Ethane | | 50 |
| Ethylene Disposition | | |
| Product | | 99.7% |
| Fuel Loss | | 0% |
| Ethane Recycle | | 0.3% |
| Compressor Requirements (HP) | | |
| Cracked Gas | | 9,000 |
| Ethylene Refrg. | | 0 |
| Propylene Refrg. | | 550 |
| Total | | 9,550 |

Referring to FIG. 10, 400 mmscfd of gas enters the cryogenic gas plant in stream GAS-IN at a pressure of 800 psig and 80° F. Any liquid is removed and the gas is dehydrated using molecular sieve before entering the gas plant demethanizer heat exchanger train in stream 2 at a pressure of 788 psig. Stream 2 is now split three (3) ways into streams 3, 9 and 11. Stream 3, which contains approximately 37.5% of stream 2 or 150 mmscfd, is the inlet gas used to reboil the G.P. demethanizer T-1. Stream 3 flows through four exchangers: (1) the G.P. demethanizer bottom reboiler E-3, (2) G.P. product exchanger E-4, (3) the E.P. deethanizer feed exchanger E-5 and (4) the G.P. demethanizer side reboiler E-6. Stream 3 exits the four exchangers in stream 8 at −61° F. and 779 psig. Stream 9, which represents 12.5% of stream 2 or 50 mmscfd, flows to the G.P. reflux exchanger E-1 and is exchanged with several cold streams and exits in stream 10 at a temperature of −100° F. and 780 psig. The cold streams are the G.P. demethanizer T-1 overhead in stream 33 and E.P. demethanizer T-3 overhead in stream 167.

Stream 11 contains the remaining 50% of stream 2 or 200 mmscfd. Here inlet gas is used for reboil heat for the E.P. ethylene tower T-4 while providing refrigeration to the inlet gas. Three (3) exchangers are used in series: (1) the G.P. gas/gas exchanger E-2, (2) the E.P. ethylene tower bottom reboiler E-10 and (3) the E.P. ethylene tower side reboiler E-11 . The inlet gas leaves the G.P. gas/gas exchanger E-2 in stream 12 at a temperature of −52° F. and 784 psig and exits the two ethylene tower T-4 reboilers, E-10 and E-11, in stream 14 at −89° F. and 780 psig. Refrigeration for the G.P. gas/gas exchanger E-2 comes from a side stream of G.P. demethanizer T-1 overhead gas coming from the G.P. reflux exchanger E-1. Streams 10 and 14 are now recombined in stream 15 and are directed to the top of the G.P. rectifier V-1 at a temperature of −91° F. and 780 psig. Stream 8, the gas plant inlet gas reboil leg, flows to the bottom of the G.P. Rectifier V-1.

The overhead from the G.P. rectifier V-1, representing 330 mmscfd at −87° F., flows to the G.P. turboexpander K-1 where it is expanded to a pressure of 289 psig and −149° F. in stream 17. The bottom off the G.P. rectifier V-1, containing 70 mmscfd at −77° F., flows to the G.P. rectifier liquid subcooler E-27 and is subcooled to −120° F. at 777 psig in stream 26. Stream 26 is now split into stream 27 and 30. Stream 27, representing 21 mmscfd, is flashed into the G.P. turboexpander K-1 discharge in stream 17. The combined stream in stream 18, containing 351 mmscfd at 289 psig and −148° F., now flows to the G.P. expander discharge separator V-2.

Stream 30, containing the remaining 70% of stream 26 or 49 mmscfd, is routed to the ethylene plant processing to provide refrigeration for the cracked gas in E-19, the E.P. gas plant exchanger. The ethylene plant cracked gas is chilled to −135° F. in stream 157 while the gas plant liquid is warmed from −140° F. in stream 30 to a temperature of −110° F. and 289 psig in stream 31. Stream 31 is now combined with stream 18 in the G.P. expander discharge separator V-2 at −143° F. and 289 psig in stream 19.

Both the vapor overhead and the liquid bottoms from the G.P. expander discharge separator V-2 and the G.P. demethanizer T-1 overhead gas are now used to condense ethylene reflux for the E.P. ethylene tower T-4 in a series of three (3) exchangers. In the first exchanger, E-24, liquid from the bottom of the G.P. expander discharge separator V-2 is used to begin condensing the ethylene from T-4 overhead in stream 189. The bottom liquid in stream 23, having been partially vaporized, exits E-24 at −124° F. and 288 psig and then flow to the G.P. rectifier liquid subcooler E-27 where it subcools G.P. rectifier V-1 bottom liquid. In the second exchanger E-25, vaporous overhead from the G.P. expander discharge separator V-2 is also used to condense ethylene and exits E-25 in stream 21 at −125° F. and 287 psig. In the final and third exchanger, E-26, the ethylene is completely condensed and subcooled to a temperature of −153° F. in stream 192 through heat exchange with stream 32, the G.P. demethanizer T-1 overhead. Stream 32, containing 472 mmscfd, enter E-26 at −159° F. and 284 psig and exits in stream 33 at −143° F. and 282 psig.

The liquid from the bottom of the G.P. expander discharge separator V-2, having passed through exchangers E-24 and E-27, now at a temperature of −110° F. and 285 psig, enters the G.P. demethanizer T-1 in stream 24 just above the center point of the tower. The gas off the top of the G.P. expander discharge separator V-2, having passed through exchanger E-25, enters the G.P . demethanizer T-1 in stream 21 just above stream 24 at −125° F.

Stream 33, the G.P. demethanizer T-1 overhead stream, after passing through the E.P. ethylene tower reflux condenser E-26, now flows to the G.P. reflux exchanger E-1. In the middle of the G.P. reflux exchanger E-1, at a temperature of approximately −70° F., a side stream of 281 mmscfd is routed via stream 34 to the G.P. gas/gas exchanger E-2. The remaining 191 mmscfd continues through the G.P. reflux exchanger E-1 and exits at 92° F. and 280 psig in stream 36. The gas routed to G.P. gas/gas exchanger E-2 exits in stream 35 at 72° F. and recombines with stream 36 in stream 37 at 280 psig and 80° F.

The combined G.P. residue stream of 472 mmscfd is next recompressed back to the gas pipeline pressure through a combination of G.P. booster compressor K-1 and G.P. recompressor C-1. The G.P. booster compressor K-1 is directly linked to the G.P. turboexpander K-1 and compresses the gas from 280 psig to 323 psig and 104° F. in stream 38. Next the residue gas is compressed by the G.P. recompressor C-1 to 800 psig and cooled to 120° F. in stream 40.

Stream 40 is now split three (3) ways into streams 41, 49 and 43. Stream 41, flowing 360 mmscfd, contains the majority of the gas and is the residue gas going back to the plant outlet pipeline. Stream 43, containing 104 mmscfd, is the methane reflux for the G.P. demethanizer T-1. Stream 43 is completely condensed in the G.P. reflux exchanger E-1 exiting the exchanger in stream 44 at −140° F. and 794 psig. Stream 44 is now split equally into streams 45 and 47. Stream 45, flowing 52 mmscfd, is then flashed into the top of the G.P. demethanizer in stream 46 a temperature of −160° F. and 285 psig. The remaining 52 mmscfd in stream 47 is flashed into the G.P. demethanizer T-1 via stream 48 in a second feed point just below the top feed. The G.P. demethanizer reflux is split into two streams for $CO_2$ freezing control.

For the G.P. demethanizer reflux residue gas is used for purposes of disclosure. There are actually at least three different places from which high pressure gas can be taken to use as a reflux for the demethanizer including (1) residue gas (2) cold separator gas and (3) inlet gas. Any one of these three sources can be used either individually or in combination with one of the other sources to provide the reflux for the G.P. demethanizer. It is unnecessary to use the more modern refluxing high ethane recovery type cryogenic plant in the gas/ethylene plant design, but the older design can also be used where the turboexpander outlet goes to the top of the G.P. demethanizer.

Stream 49, flowing 7.5 mmscfd, is the methane reflux for the E.P. demethanizer T-3. Any $CO_2$ or $H_2S$ are removed by treating the processed gas through an amine contactor and a caustic wash and then dehydrated using a molecular sieve. The treated gas now flows to the G.P. reflux exchanger E-1 where it is totally condensed and exits the exchanger in stream 57 at −140° F. and 794 psig. The liquid methane now flows to the E.P. demethanizer T-3 which will be discussed in more detail later.

The NGL product is demethanized in the G.P. demethanizer T-1 to a purity of no greater than 3% methane in the ethane. The overhead from the G.P. demethanizer T-1, stream 32, at −159° F. and 284 psig, flows to E-26 as discussed above to condense and subcool E.P. ethylene tower T-3 overhead ethylene. The liquid NGL product leaves the bottom of the G.P. demethanizer T-1 in stream 64 at 49° F. and 286 psig. This stream is next subcooled in the G.P. product subcooler E-7 by flashing a portion of the stream back through E-7. The NGL liquid is subcooled in stream 65 to a −12° F. and then split into three (3) streams.

The first stream in stream 69, representing approximately 40% or 13 mmscfd, is flashed to a pressure of 116 psig and −16° F. and used in the G.P. product subcooler E-7 to subcool the NGL product. Stream 71 leaves E-7 at 113 psig and 23° F. and flows to the G.P. deethanizer T-2 approximately three fourths of the way up from the bottom of the tower. Stream 67, containing 21% or 6.8 mmscfd, is flashed to the top of the G.P. deethanizer T-2 for use as reflux. The remaining 12.6 mmscfd is flashed via stream 72 to the G.P. product exchanger E-4 to chill inlet gas. The stream exits E-4 at 112 psig and 20.4° F. and flows to the G.P. deethanizer T-2 just above the mid-point of the tower in stream 74.

Coming off the top of the G.P. deethanizer T-2 in stream 76 is the vaporous ethane/propane feed to the ethylene plant crackers. Stream 76 contains 22.9 mmscfd or 82,002 lbs/hr (80% ethane, 12.6% propane, 3.5% butane plus and 3.9% carbon dioxide), at 110 psig and 4° F. From the top of the G.P. deethanizer T-2, stream 76 flows to the G.P. deethanizer overhead exchanger E-12 and is heated to 95° F. while chilling cracked gas. The E.P. cracker feed is now treated through an amine contactor to remove $CO_2$ and trace $H_2S$ and exits the treating systems in stream 81 at 85 psig and 97° F. Here it is combined in stream 211 with ethane recycle from the E.P. deethanizer T-5 in stream 210 to make the feed to the ethylene plant crackers.

Coming off the bottom of the G.P. deethanizer T-2 is a propane plus mixture. This mixture can be further fractionated into its individual components and sold or sold as mixed C3+ product. Additionally, although it is not considered in this example of a gas/ethylene plant, some of the C3+ product could also be routed to the E.P. cracking furnaces either as a pure feed or as a mixed feed.

As discussed earlier, the ethylene processing plant in FIG. 3 omits the front end of the plant including furnaces, quench tower and exchangers, cracked gas compressor, caustic tower, hydrogenation and dehydration. Note that the hydrogenation can also be located at the back-end of the plant under certain arrangements or an acetylene recovery system could be installed . This is because in the present invention, the front end of the plant is identical to a typical ethylene plant and thus was omitted to simplify the disclosure and set forth changes made by the embodiments of the present invention. The difference is that in the present inventions the cracked gas is compressed to 205 psig instead of the 475 psig to 500 psig, saving approximately 25% in horsepower and saving in piping and equipment cost due to the lower pressure. Note that in the present invention the cracked gas could be compressed to 475 psig to 500 psig.

The NGL feed for the cracking furnaces does not completely have to come from the cryogenic natural gas plant. Some or all of the furnace feed can come from outside sources and even can be a liquid feed such as naphtha. In addition, some or all of the cracked gas can be already cracked gas such as a refinery off gas.

Cracked gas in stream 145, at a flow rate of 52.5 mmscfd or 111,905 lbs/hr, enters the E.P. demethanizer T-3 heat exchanger train at 163 psig and 100° F. Stream 145 is now split into streams 146 and 151. Stream 151 provides the reboil heat for the E.P. demethanizer T-3 while chilling the cracked gas and contains 17.6 mmscfd or 33.5% of stream 145. Stream 151 passes through four (4) exchangers: (1) the E.P. deethanizer overhead exchanger E-13, (2) the E.P. demethanizer reboiler chiller E-15, (3) the E.P. demethanizer bottom reboiler E-17 and (4) the E.P. demethanizer side reboiler E-18. Stream 151 exits these four exchangers in stream 155 at −90° F. and 155 psig.

The remaining 66.5%, of stream 145 or 34.9 mmscfd flows to stream 146 and passes through three (3) exchangers while being chilled to −95.7° F. in stream 149. The exchangers are: (1) the G.P. deethanizer overhead exchanger E-12, (2) the E.P. ethylene product exchanger E-14 and (3) the E.P. ethylene tower feed exchanger E-16. Stream 149 is now recombined with stream 155 in stream 156 at −93.7° F. and 155 psig. Stream 156 is further chilled to −135° F. at 152 psig in the E.P. gas plant exchanger E-19 by heat exchange with subcooled G.P. rectifier V-1 bottoms liquid. The ethylene plant demethanizer heat exchanger train described in the previous paragraph is a simple design, and more elaborate arrangements could be used including the use of patented dephlegmator-type units.

Stream 157 next flows to the E.P. cold separator V-3 from which the vaporous overhead in stream 160 is directed to the E.P. turboexpander K-2. Stream 160 consisting of 24.5 mmscfd or 21,185 lbs/hr is expanded from a pressure of 152 psig and −135° F. to 52 psig and −172° F. in stream 161. Stream 161 now flows to the E.P. demethanizer reflux exchanger E-20 and is chilled to −184° F. before entering the E.P. demethanizer T-3 in stream 162 approximately two thirds up from the bottom of the tower. Refrigeration in the E.P. demethanizer reflux exchanger E-20 comes from the cold E.P. demethanizer T-3 overhead in stream 166. The bottom liquids from the E.P. cold separator V-3 also flow to the E.P. demethanizer reflux exchanger E-20 and then to the E.P. demethanizer T-3. Stream 162 is chilled from −135° F. to −142° F. in The E.P. demethanizer reflux exchanger E-20 and then flashed into stream 165 and enters the E.P. demethanizer T-3 at −143° F. and 50 psig.

Reflux for the E.P. demethanizer T-3 comes from liquid methane condensed in the gas plant. In stream 57, 7.5 mmscfd of methane has been condensed at 778 psig and −140° F. and directed to the E.P. demethanizer reflux exchanger E-20. Stream 57 is further chilled to −243° F. in the demethanizer reflux exchanger E-20 and then flashed into the top of the E.P. demethanizer T-3 in stream 159 at 50 psig and −240° F.

In the ethylene plant demethanizer T-3, the ethylene is demethanized to a specification of no greater than 120 PPM by volume of methane in the ethylene. Heat to reboil the E.P. demethanizer T-3, as discussed earlier, comes from heat exchange with ethylene plant inlet cracked gas. The overhead from the E.P. demethanizer T-3 leaves the tower in stream 166 at −246° F. and 49 psig. Stream 166 flows to the E.P. demethanizer reflux exchanger E-20 and provides refrigeration to the three (3) warm streams discussed earlier, (stream 146 and E-12, E-14, E-16 exchangers). Stream 167 exits the E.P. demethanizer reflux exchanger E-20 at −141° F. and 47 psig and flows to the G.P. reflux exchanger E-1. Here stream 167 is warmed through heat exchange with various inlet streams to 92° F. and 45 psig in stream 168. Stream 168 is now compressed by the E.P. booster compressor K-2 to 60 psig and is used as plant fuel.

The demethanized liquid off the bottom of the E.P. demethanizer T-3, representing 29.7 mmscfd or 98,377 lbs/hr, leaves the tower in stream 178 at 53 psig and −87.6° F. Stream 178 is then flashed into stream 179 at approximately 38 psig and −98.7° F., which is the pressure required to force the stream into the E.P. ethylene tower T-4. Before going to E.P. ethylene tower T-4, stream 179 next flows through the E.P. ethylene tower feed exchanger E-16 chilling ethylene plant inlet cracked gas as explained earlier. Stream 180 exits E-16 at −97.3° F. and 36 psig and flows to the E.P. ethylene tower T-4 entering at 33 psig just below the mid-point of the tower.

In the E.P. ethylene tower T-4, the ethylene is purified to a specification of no greater than 80 PPM by volume of ethane in the ethylene. Reboiler heat, as described earlier, is provided through heat exchange with gas plant inlet gas in ethylene tower bottom and side reboilers E-10 and E-11. To provide reflux for the E.P. ethylene tower T-4, the overhead from the tower in stream 188, containing approximately 53.9 mmscfd or 166,060 lbs/hr at 25 psig and −120.9° F., is routed through three (3) exchangers which together are called the E.P. ethylene tower reflux condenser E-24, E-25 and E-26. A small side stream, stream 193, is taken off before the condensing exchangers and used to control the condensing pressure by bypassing gas around the exchangers. In the E.P. ethylene tower reflux condenser, the ethylene is totally condensed and subcooled to −153.4° F. in stream 192 by heat exchanger with G.P. expander separator V-2 bottom liquids in E-24, heat exchange with G.P. expander separator V-2 overhead gas in E-25 and by heat exchange with G.P. demethanizer T-1 overhead gas in E-26. The subcooled stream 192 is now recombined with the bypassed vapor in stream 193 to make a totally condensed ethylene stream in stream 195 at −123.1° F. and 23 psig.

Stream 195 is now routed to the E.P. ethylene tower reflux accumulator V-4 from where it is pumped by the E.P. ethylene reflux pump P-2 to a pressure of approximately 90 psig and −121.7° F. Stream 197 is now split into reflux and product streams. Stream 202, containing approximately 33% of stream 197 or 17.8 mmscfd and 54,925 lbs/hr, is the ethylene plant product. Stream 202 is pumped up to 503 psig by the E.P. ethylene product pump P-3 and before leaving the plant is routed through E-14, the E.P. ethylene product exchanger to recover refrigeration by chilling inlet cracked gas. The ethylene product exits the plant slightly subcooled in stream 203 at 500 psig and 10.6° F. Stream 200, which contains the balance of stream 197 or 36.1 mmscfd and 111,166 lbs/hr is flashed back into the top of the E.P. ethylene tower T-4 providing reflux for the tower.

Coming off the bottom of the E.P. ethylene tower T-4 in stream 187 at 35 psig and −74.3° F. is an ethane plus product mix of 11.89 mmscfd or 43,458 lbs/hr. Stream 187 is pumped to 112 psig in stream 204 by the E.P. deethanizer feed pumps P-1. Before entering the E.P. deethanizer T-5, refrigeration is recovered in the E.P. deethanizer feed heater E-5 for use in the gas plant to chill inlet gas as described earlier in the gas plant section. Stream 205 exits the E.P. deethanizer feed heater E-5 at 110 psig and −2.1° F. and feeds the E.P. deethanizer T-5 just below the mid-point of the tower.

Being produced off the top of the E.P. deethanizer T-5 in stream 209, at 109 psig and −32.6° F., is gaseous ethane which is recycled back as feed to the E.P. crackers. Stream 209 contains 10.4 mmscfd or 34,329 lbs/hr. Reflux for the E.P. deethanizer T-5 is produced in the E.P. deethanizer reflux condenser E-21 by condensing E.P. deethanizer T-5 overhead gas with a small amount of external propane refrigerant. The gaseous ethane in stream 209 is next flashed to 88 psig and −37.9° F. and routed through the E.P. deethanizer overhead exchanger E-13 to chill inlet cracked gas. Stream 210 exits the E.P. deethanizer overhead exchanger E-13 at 85 psig and 95.6° F. and is then combined with the vaporized feedstock from the gas plant in stream 81 to form the E.P. cracker feed in stream 211.

Stream 207, consisting of 1.5 mmscfd or 9,129 lbs/hr of a mixed propylene plus product, comes off the bottom of the E.P. deethanizer T-5 at 112 psig and 97.8° F. The stream can now be further fractionated to recover propylene, recycled to the crackers or sold as a plant product.

The ethylene plant deethanizer is located after the demethanizer in this example. In many modern designs the deethanizer or even a depropanizer or a debutanizer is located in front of the demethanizer. Concerning the gas/ethylene plant, for purposes of disclosure we chose for this example to put the deethanizer in the back of the plant but a front end deethanizer, depropanizer or debutanizer can certainly be used in the gas/ethylene plant design if that is the designer's choice.

All of the advantages of the gas/ethylene plant have been set forth throughout the entire specification. Presented in this section is a summary of those advantages.

TABLE 4

Compression Horsepower Requirements

| | Prior Art | Invention Gas/Ethylene Plant |
|---|---|---|
| GAS PLANT | | |
| Recompressor | 23,200 | 27,400 |
| Propane Refrg. | 1,700 | 0 |
| Total | 24,900 | 27,400 |
| ETHYLENE PLANT | | |
| Cracked Gas | 12,000 | 9,000 |
| Ethylene Refrg. | 4,700 | 0 |
| Propylene Refrg. | 6,100 | 550 |
| Total | 22,800 | 9,550 |
| Additional Steam HP Available | 0 | (13,250)* |
| Combined Total Ethylene Plant | 22,800 | (3,700) |
| TOTAL BOTH PLANTS (Net) | 47,700 | 23,700 |

*Note: This represents excess steam horsepower generated in the E. P. quench exchangers after meeting compressor turbine requirements when using condensing steam turbines.

Presented in Table 4 is a comparison of the net compressor horsepower requirements for the prior art versus the invention (the gas/ethylene plant). Net compressor horsepower requirements for prior art is 47,700 hp versus 23,700 hp for the gas/ethylene plant or a 24,000 hp reduction. This represents approximately a 50% reduction in net horsepower or in unitized terms presents a reduction of 0.44 horsepower per pound of ethylene produced.

The second major area of advantage is the pressure required in the ethylene plant. Conventional ethylene plants compress the cracked gas up to 475 to 500 psig, whereas in the gas/ethylene plant, the cracked gas is only compressed to 205 psig. This not only saves cracked gas compression horsepower, as indicated earlier, but the lower pressure substantially reduces the capital and installation cost of all the equipment and piping in the ethylene plant.

The third area of advantage is in the large reduction in the number of major pieces of equipment required over prior art resulting in a substantial capital cost savings. The majority of this reduction comes from three areas: (1) the elimination of the ethylene/heat pump refrigeration system in the ethylene plant, (2) the simplification of the ethylene plant demethanizer heat exchanger train, and (3) the simplification and reduction in size of the propylene refrigeration system in FIG. 4, illustrating the prior art ethylene refrigeration system. Note the number of pieces of equipment not required by eliminating this system. These are large and costly pieces of equipment due to the large flow rates in the ethylene refrigeration system and the stainless steel requirements due to cryogenic temperatures. Secondly, concerning the ethylene plant demethanizer heat exchanger train, again compare the current design in FIG. 3 versus the gas/ethylene plant in FIG. 10. There is almost a 50% reduction in the number of pieces of equipment required and the simplicity of the gas/ethylene plant design. Finally, consider the propylene refrigeration system. Most modern ethylene plants have large three or four stage systems. The gas/ethylene plants propane refrigeration system is 10% the size of the Prior Art system and is a simple two stage system.

The fourth advantage is in the ethylene recovery of the gas/ethylene plant. Referring to Tables 2 and 3, the gas/ethylene plants ethylene recovery, when including the ethylene in the ethane recycle, is 100% versus 98.7% for the conventional ethylene plant. Conventional ethylene plants strain to get high ethylene recovery whereas the gas/ethylene plant with its almost limitless methane reflux from the gas plant, can easily obtain and sustain a theoretical 100% ethylene recovery.

Finally, the gas/ethylene plant design can be used advantageously to retrofit existing cryogenic natural gas plants and ethylene plants as well as in the design of new grass-root facilities.

It is understood that while the foregoing embodiments have been described in considerable detail for the purpose of disclosure, many variations may be made therein. Furthermore, the percentages, operating temperatures and pressures specified in the above examples can be varied considerably for any given mixture.

Accordingly, the present invention is well suited and adapted to attain the objects and ends and has the advantages and features mentioned as well as others inherent therein.

While presently preferred embodiments of the invention have been given for the purpose of disclosure, changes can be made therein which are within the spirit of the invention as defined by the scope of the appended claims.

We claim:

1. In a method of producing ethylene including a cryogenic natural gas liquid processing plant, an ethylene plant demethanizer heat exchanger train, an ethylene plant distillation tower and an ethylene plant demethanizer distillation column, the improvement selected from the group consisting of, chilling the ethylene plant demethanizer heat exchange train with a refrigerated stream or streams from the cryogenic natural gas liquid processing plant effective to provide ethylene level refrigeration, condensing the ethylene distillation tower overhead with ethylene level refrigeration stream or streams from the cryogenic natural gas liquid processing plant, refluxing the ethylene plant demethanizer distillation column with a predominantly methane mixture from the cryogenic natural gas liquid processing plant, and combinations thereof.

2. The method of claim 1 where chilling the ethylene plant demethanizer heat exchanger train with a refrigerated stream or streams from the cryogenic natural gas liquid processing plant effective to provide ethylene level refrigeration is selected comprising, (a) dehydrating a high pressure inlet natural gas stream of the cryogenic natural gas liquid processing plant;

(b) chilling the high pressure inlet natural gas stream of the cryogenic natural gas liquid processing plant through one or a combination of heat exchange with internal cryogenic natural gas liquid processing plant or ethylene plant streams, external mechanical propane or propylene refrigeration, or external ethane or ethylene mechanical refrigeration;

(c) expanding the chilled high pressure inlet natural gas stream of the cryogenic natural gas liquid processing plant into a lower pressure cryogenic natural gas liquid processing plant demethanizer distillation column;

(d) demethanizing the chilled high pressure inlet natural gas stream of the cryogenic natural gas liquid processing plant in a cryogenic natural gas liquid processing plant demethanizer distillation column with a vaporous and predominantly methane stream produced off the top of the cryogenic natural gas liquid processing plant demethanizer and an ethane plus natural gas liquid mixture produced off the bottom of the cryogenic natural gas liquid processing plant demethanizer;

(e) at least one of cracking all or part of the cryogenic natural gas liquid processing plant ethane plus natural gas liquid mixture in an ethylene plant cracking furnace producing ethylene plant inlet cracked gas, cracking other externally produced natural gas liquids in an ethylene plant cracking furnace producing ethylene plant inlet cracked gas, cracking other externally produced petroleum based naptha type liquids in an ethylene plant cracking furnace producing ethylene plant inlet cracked gas, obtaining cracked gas from a refinery to be used as ethylene plant inlet cracked gas, obtaining olefin rich gas from a catalytic dehydrogenation reactor;

(f) at least one of compressing the ethylene plant inlet cracked gas in an ethylene plant inlet cracked gas compressor, receiving high pressure refinery cracked gas, receiving high pressure olefin rich gas from a catalytic dehydrogenation reactor;

(g) treating the compressed ethylene plant inlet cracked gas for acid gas removal including hydrogen sulfide and carbon dioxide gases;

(h) dehydrating the treated ethylene plant inlet cracked gas;

(i) at least one of treating the dehydrated ethylene plant inlet cracked gas for acetylene removal through hydrogenation or through an acetylene recovery system or treating the ethylene plus mixture produced off the bottom of the ethylene plant demethanizer distillation column for acetylene removal through hydrogenation or through an acetylene recovery system, treating the fractionated components of the ethylene plus mixture from the bottom of the ethylene plant demethanizer distillation column for acetylene removal through hydrogenation or through an acetylene recovery system;

(j) chilling the ethylene plant inlet cracked gas in an ethylene plant demethanizer heat exchange train through one of heat exchange with internal ethylene plant or cryogenic natural gas liquid processing plant streams, external mechanical propane or propylene refrigeration, external mechanical ethane or ethylene refrigeration, ethylene level refrigeration available from heat exchange with internal streams from the cryogenic natural gas liquid processing plant low pressure side or a combination thereof;

(k) replacing the ethylene level refrigeration taken from the low pressure side of the cryogenic natural gas liquid processing plant used in the ethylene plant demethanizer heat exchanger train with refrigeration effective to sustain the cryogenic natural gas liquid processing plant ethane plus liquid production with the replacement refrigeration coming from one or a combination of heat exchange with the internal cryogenic natural gas liquid processing plant or ethylene plant streams or external mechanical refrigeration, with such refrigeration being positioned on the high pressure side of the cryogenic natural gas liquid processing plant;

(l) demethanizing the chilled ethylene plant inlet cracked gas in an ethylene plant demethanizer distillation column with a vaporous and predominantly methane mixture coming off the top of the ethylene plant demethanizer and a liquid ethylene plus mixture produced off the bottom of the ethylene plant demethanizer; and (m) fractionating the ethylene plant ethylene plus liquid mixture in one or more distillation columns thereby producing olefins and other products.

3. The method of claim 1 where condensing the ethylene distillation tower overhead with an ethylene level refrigeration stream or streams from the cryogenic natural gas liquid processing plant is selected comprising, (a) dehydrating a high pressure inlet natural gas stream of the cryogenic natural gas liquid processing plant;

(b) chilling the high pressure inlet natural gas stream of the cryogenic natural gas liquid processing plant through one or a combination of heat exchange with internal cryogenic natural gas liquid processing plant or ethylene plant streams, external mechanical propane or propylene refrigeration, external ethane or ethylene mechanical refrigeration;

(c) expanding the chilled high pressure inlet natural gas stream of the cryogenic natural gas liquid processing plant into a lower pressure cryogenic natural gas liquid processing plant demethanizer distillation column;

(d) demethanizing the chilled high pressure inlet natural gas stream of the cryogenic natural gas liquid processing plant in a cryogenic natural gas plant liquid processing demethanizer distillation column with a vaporous and predominantly methane stream produced off the top of the cryogenic natural gas liquid processing plant demethanizer and an ethane plus natural gas liquid mixture produced off the bottom of the cryogenic natural gas liquid processing plant demethanizer;

(e) at least one of cracking all or part of the cryogenic natural gas liquid processing plant ethane plus liquid mixture in an ethylene plant cracking furnace producing ethylene plant inlet cracked gas, cracking other externally produced natural gas liquids in an ethylene plant cracking furnace producing ethylene plant inlet cracked gas, cracking other externally produced petroleum based naptha type liquids in an ethylene plant cracking furnace producing ethylene plant inlet cracked gas, obtaining cracked gas from a refinery to be used as ethylene plant inlet cracked gas, obtaining olefin rich gas from a catalytic dehydrogenation reactor;

(f) at least one of compressing the ethylene plant inlet cracked gas in an ethylene plant inlet cracked gas compressor, receiving high pressure refinery cracked gas, receiving high pressure olefin rich gas from a catalytic dehydrogenation reactor;

(g) treating the compressed ethylene plant inlet cracked gas for acid gas removal including hydrogen sulfide and carbon dioxide gases;

(h) dehydrating the treated ethylene plant inlet cracked gas;

(i) at least one of treating the dehydrated ethylene plant inlet cracked gas for acetylene removal through hydrogenation, or through an acetylene recovery system or treating the ethylene plus mixture being produced off the bottom of the ethylene plant demethanizer distillation column for acetylene removal through hydrogenation, or through an acetylene recovery system, treating the fractionated components of the ethylene plus mixture from the bottom of the ethylene plant demethanizer distillation column for acetylene removal through hydrogenation or through an acetylene recovery system;

(j) chilling the ethylene plant inlet cracked gas in an ethylene plant demethanizer heat exchange train through one or a combination of heat exchange with internal ethylene plant or cryogenic natural gas liquid processing plant streams, external mechanical propane or propylene refrigeration, external mechanical ethane or ethylene refrigeration;

(k) demethanizing the chilled ethylene plant inlet cracked gas in an ethylene plant demethanizer distillation column with a vaporous and predominantly methane mixture coming off the top of the ethylene plant demethanizer and a liquid ethylene plus mixture produced off the bottom of the ethylene plant demethanizer;

(l) fractionating the ethylene plant ethylene plus liquid mixture in one or more distillation columns including an ethylene plant ethylene distillation tower thereby producing olefins and other products;

(m) condensing partially or totally the ethylene plant ethylene distillation tower overhead vapor effective to make ethylene distillation tower reflux or ethylene product through heat exchange with ethylene level refrigeration stream or streams from the low pressure side of the cryogenic natural gas liquid processing plant;

(n) replacing the ethylene level refrigeration taken from the low pressure side of the cryogenic natural gas liquid processing plant used in the ethylene plant ethylene distillation tower in condensing ethylene distillation tower overhead vapor with refrigeration effective to sustain the cryogenic natural gas liquid processing plant ethane plus natural gas liquid production with the replacement refrigeration coming from one or a combination of heat exchange with internal cryogenic natural gas liquid processing plant or ethylene plant streams or external mechanical refrigeration, such refrigeration positioned on the high pressure side of the cryogenic natural gas liquid processing plant.

4. The method of claim 1 where refluxing the ethylene plant demethanizer distillation column with a predominantly methane mixture from the cryogenic natural gas liquid processing plant is selected comprising, (a) dehydrating a high pressure inlet natural gas stream of the cryogenic natural gas liquid processing plant;

(b) chilling the high pressure inlet natural gas plant through one or a combination of heat exchange with internal cryogenic natural gas liquid processing plant or ethylene plant streams, external mechanical propane or propylene refrigeration, or external ethane or ethylene mechanical refrigeration;

(c) expanding the chilled high pressure inlet natural gas stream of the cryogenic natural gas liquid processing plant into a lower pressure cryogenic natural gas liquid processing plant demethanizer distillation column;

(d) demethanizing the chilled high pressure inlet natural gas stream of the cryogenic natural gas liquid processing plant in a cryogenic natural gas liquid processing plant demethanizer distillation column with a vaporous and predominantly methane stream produced off the top of the cryogenic natural gas liquid processing plant demethanizer and an ethane plus natural gas liquid mixture produced off the bottom of the cryogenic natural gas liquid processing plant demethanizer;

(e) at least one of cracking all or part of the cryogenic natural gas liquid processing plant ethane plus liquid mixture in an ethylene plant cracking furnace producing ethylene plant inlet cracked gas, cracking other externally produced natural gas liquids in an ethylene plant cracking furnace producing ethylene plant inlet cracked gas, cracking other externally produced petroleum based naptha type liquids in an ethylene plant cracking furnace producing ethylene plant inlet cracked gas, obtaining cracked gas from a refinery to be used as ethylene plant inlet cracked gas, obtaining olefin rich gas from a catalytic dehydrogenation reactor;

(f) at least one of compressing the ethylene plant inlet cracked gas in an ethylene plant inlet cracked gas compressor, receiving high pressure refinery cracked gas, receiving high pressure olefin rich gas from a catalytic dehydrogenation reactor;

(g) treating the compressed ethylene plant inlet cracked gas for acid gas removal including hydrogen sulfide and carbon dioxide gases;

(h) dehydrating the treated ethylene plant inlet cracked gas;

(i) at least one of treating the dehydrated ethylene plant inlet cracked gas for acetylene removal through hydrogenation, or through an acetylene recovery system, treating the ethylene plus mixture being produced off the bottom of the ethylene plant demethanizer distillation column for acetylene removal through hydrogenation, or through an acetylene recovery system, treating the fractionated components of the ethylene plus mixture coming from the bottom of the ethylene plant demethanizer distillation column for acetylene removal through hydrogenation or through an acetylene recovery system;

(j) chilling the ethylene plant inlet cracked gas in an ethylene plant demethanizer heat exchange train through one or a combination of heat exchange with internal ethylene plant or cryogenic natural gas liquid processing plant streams, external mechanical propane or propylene refrigeration, external mechanical ethane or ethylene refrigeration;

(k) demethanizing the chilled ethylene plant inlet cracked gas in an ethylene plant demethanizer distillation column with a vaporous and predominantly methane mixture coming off the top of the ethylene plant demethanizer and a liquid ethylene plus mixture produced off the bottom of the ethylene plant demethanizer;

(l) refluxing the ethylene plant demethanizer distillation column with a predominantly methane mixture from the cryogenic natural gas liquid processing plant; and (m) fractionating the ethylene plant ethylene plus liquid mixture in one or more distillation columns thereby producing olefins and other products.

5. In an apparatus for producing ethylene including a cryogenic natural gas liquid processing plant, an ethylene plant demethanizer heat exchanger train, an ethylene plant distillation tower and an ethylene plant demethanizer distillation column, the improvement being selected from the group consisting of, means for chilling the ethylene plant demethanizer heat exchanger train with a refrigerated stream or streams from a cryogenic natural gas liquid processing plant effective to provide ethylene level refrigeration, means for condensing the ethylene distillation tower overhead with ethylene level refrigeration stream or streams from the cryogenic natural gas liquid processing plant, means for refluxing the ethylene plant demethanizer distillation column with a predominantly methane mixture from the cryogenic natural gas liquid processing plant, and combinations thereof.

6. The apparatus of claim 5 where the means for chilling the ethylene plant demethanizer heat exchanger train with a refrigerated stream or streams from a cryogenic natural gas liquid processing plant effective to provide ethylene level refrigeration is selected comprising, (a) means for dehydrating a high pressure inlet natural gas stream of the cryogenic natural gas liquid processing plant;

(b) means for chilling the high pressure inlet natural gas stream of the cryogenic natural gas liquid processing plant through one or a combination of heat exchange with internal cryogenic natural gas liquid processing plant or ethylene plant streams, external mechanical propane or propylene refrigeration, or external ethane or ethylene mechanical refrigeration;

(c) means for expanding the chilled high pressure inlet natural gas stream of the cryogenic natural gas liquid processing plant into a lower pressure cryogenic natural gas liquid processing plant demethanizer distillation column;

(d) means for demethanizing the chilled high pressure inlet natural gas stream of the cryogenic natural gas liquid processing plant in a cryogenic natural gas liquid processing plant demethanizer distillation column with a vaporous and predominantly methane stream produced off the top of the cryogenic natural gas liquid processing plant demethanizer and an ethane plus natural gas liquid mixture produced off the bottom of the cryogenic natural gas liquid processing plant demethanizer;

(e) at least one means for cracking all or part of the cryogenic natural gas liquid processing plant ethane plus natural gas liquid mixture in an ethylene plant cracking furnace producing ethylene plant inlet cracked gas, cracking other externally produced natural gas liquids in an ethylene plant cracking furnace producing ethylene plant inlet cracked gas, cracking other externally produced petroleum based naptha type liquids in an ethylene plant cracking furnace producing ethylene plant inlet cracked gas, obtaining cracked gas from a refinery to be used as ethylene plant inlet cracked gas, obtaining olefin rich gas from a catalytic dehydrogenation reactor;

(f) at least one of means for compressing the ethylene plant inlet cracked gas in an ethylene plant inlet cracked gas compressor, receiving high pressure refinery cracked gas, receiving high pressure olefin rich gas from a catalytic dehydrogenation reactor;

(g) means for treating the compressed ethylene plant inlet cracked gas for acid gas removal including hydrogen sulfide and carbon dioxide gases;

(h) means for dehydrating the treated ethylene plant inlet cracked gas;

(i) at least one means for treating the dehydrated ethylene plant inlet cracked gas for acetylene removal through hydrogenation or through an acetylene recovery system, treating the ethylene plus mixture produced off the bottom of the ethylene plant demethanizer distillation column for acetylene removal through hydrogenation or through an acetylene recovery system, treating the fractionated components of the ethylene plus mixture from the bottom of the ethylene plant demethanizer distillation column for acetylene removal through hydrogenation or through an acetylene recovery system;

(j) means for chilling the ethylene plant inlet cracked gas in an ethylene plant demethanizer heat exchange train through one of heat exchange with internal ethylene plant or cryogenic natural gas liquid processing plant streams, external mechanical propane or propylene refrigeration, external mechanical ethane or ethylene refrigeration, ethylene level refrigeration available from heat exchange with internal streams from the cryogenic natural gas liquid processing plant low pressure side or combinations thereof;

(k) means for replacing the ethylene level refrigeration taken from the low pressure side of the cryogenic natural gas liquid processing plant used in the ethylene plant demethanizer heat exchanger train with refrigeration effective to sustain the cryogenic natural gas liquid processing plant ethane plus natural gas liquid production with the replacement refrigeration coming from one or a combination of heat exchange with internal cryogenic natural gas liquid processing plant or ethylene plant streams or external mechanical refrigeration, with such refrigeration being positioned on the high pressure side of the cryogenic natural gas liquid processing plant;

(l) means for demethanizing the chilled ethylene plant inlet cracked gas in an ethylene plant demethanizer distillation column with a vaporous and predominantly methane mixture coming off the top of the ethylene plant demethanizer and a liquid ethylene plus mixture produced off the bottom of the ethylene plant demethanizer; and (m) means for fractionating the ethylene plant ethylene plus liquid mixture in one or more distillation columns thereby producing olefins and other products.

7. The apparatus of claim 5 where the means for condensing the ethylene distillation tower overhead with an ethylene level refrigeration stream or streams from the cryogenic natural gas liquid processing plant is selected comprising, (a) dehydrating a high pressure inlet natural gas stream of the cryogenic natural gas liquid processing plant;

(b) means for chilling the high pressure inlet natural gas stream of the cryogenic natural gas liquid processing plant through one or a combination of heat exchange with internal cryogenic natural gas liquid processing plant or ethylene plant streams, external mechanical propane or propylene refrigeration, external ethane or ethylene mechanical refrigeration;

(c) means for expanding the chilled high pressure inlet natural gas stream of the cryogenic natural gas liquid processing plant into a lower pressure cryogenic natural gas liquid processing plant demethanizer distillation column;

(d) means for demethanizing the chilled high pressure inlet natural gas stream of the cryogenic natural gas liquid processing plant in a cryogenic natural gas liquid processing plant demethanizer distillation column with a vaporous and predominantly methane stream produced off the top of the cryogenic natural gas liquid processing plant demethanizer and an ethane plus natural gas liquid mixture produced off the bottom of the cryogenic natural gas liquid processing plant demethanizer;

(e) at least one means for cracking all or part of the cryogenic natural gas liquid processing plant ethane plus natural gas liquid mixture in an ethylene plant cracking furnace producing ethylene plant inlet cracked gas, cracking other externally produced natural gas liquids in an ethylene plant cracking furnace producing ethylene plant inlet cracked gas, cracking other externally produced petroleum based naptha type liquids in an ethylene plant cracking furnace producing ethylene plant inlet cracked gas, obtaining cracked gas from a refinery to be used as ethylene plant inlet cracked gas, obtaining olefin rich gas from a catalytic dehydrogenation reactor;

(f) at least one means for compressing the ethylene plant inlet cracked gas in an ethylene plant inlet cracked gas compressor, receiving high pressure refinery cracked gas, receiving high pressure olefin rich gas from a catalytic dehydrogenation reactor;

(g) means for treating the compressed ethylene plant inlet cracked gas for acid gas removal including hydrogen sulfide and carbon dioxide gases;

(h) means for dehydrating the treated ethylene plant inlet cracked gas;

(i) at least one means for treating the dehydrated ethylene plant inlet cracked gas for acetylene removal through hydrogenation or through an acetylene recovery system or treating the ethylene plus mixture produced off the bottom of the ethylene plant demethanizer distillation column for acetylene removal through hydrogenation or through an acetylene recovery system, treating the fractionated components of the ethylene plus mixture coming from the bottom of the ethylene plant demethanizer distillation column for acetylene removal through hydrogenation or through an acetylene recovery system;

(j) means for chilling the ethylene plant inlet cracked gas in an ethylene plant demethanizer heat exchange train through one or a combination of heat exchange with internal ethylene plant or cryogenic natural gas liquid processing plant streams, external mechanical propane or propylene refrigeration, external mechanical ethane or ethylene refrigeration;

(k) means for demethanizing the chilled ethylene plant inlet cracked gas in an ethylene plant demethanizer distillation column with a vaporous and predominantly methane mixture coming off the top of the ethylene plant demethanizer and a liquid ethylene plus mixture produced off the bottom of the ethylene plant demethanizer;

(l) means for fractionating the ethylene plant ethylene plus liquid mixture in one or more distillation columns including an ethylene plant ethylene distillation tower thereby producing olefins and other products;

(m) means for condensing partially or totally the ethylene plant ethylene distillation tower overhead vapor effective to make ethylene distillation tower reflux or ethylene product through heat exchange with ethylene level refrigeration stream or streams from the low pressure side of the cryogenic natural gas liquid processing plant;

(n) means for replacing the ethylene level refrigeration taken from the low pressure side of the cryogenic natural gas liquid processing plant used in the ethylene plant ethylene distillation tower in condensing ethylene distillation tower overhead vapor with refrigeration effective to sustain the cryogenic natural gas liquid processing plant ethane plus natural gas liquid production with the replacement refrigeration coming from one or a combination of heat exchange with internal cryogenic natural gas liquid processing plant or ethylene plant streams or external mechanical refrigeration, with such refrigeration positioned on the high pressure side of the cryogenic natural gas liquid processing plant.

8. The apparatus of claim 5 where refluxing the ethylene plant demethanizer distillation column with a predominantly methane mixture from the cryogenic natural gas liquid processing plant is selected comprising, (a) means for dehydrating a high pressure inlet natural gas stream of the cryogenic natural gas liquid processing plant;

(b) means for chilling the high pressure inlet natural gas plant through one or a combination of heat exchange with internal cryogenic natural gas liquid processing plant or ethylene plant streams, external mechanical propane or propylene refrigeration, or external ethane or ethylene mechanical refrigeration;

(c) means for expanding the chilled high pressure inlet natural gas stream of the cryogenic natural gas liquid processing plant into a lower pressure cryogenic natural gas liquid processing plant demethanizer distillation column;

(d) means for demethanizing the chilled high pressure inlet natural gas stream of the cryogenic natural gas liquid processing plant in a cryogenic natural liquid processing gas plant demethanizer distillation column with a vaporous and predominantly methane stream produced off the top of the cryogenic natural gas liquid processing plant demethanizer and an ethane plus natural gas liquid mixture produced off the bottom of the cryogenic natural gas liquid processing plant demethanizer;

(e) at least one means for cracking all or part of the cryogenic natural gas liquid processing plant ethane plus natural gas liquid mixture in an ethylene plant cracking furnace producing ethylene plant inlet cracked gas, cracking other externally produced natural gas liquids in an ethylene plant cracking furnace producing ethylene plant inlet cracked gas, cracking other externally produced petroleum based naptha type liquids in an ethylene plant cracking furnace producing ethylene plant inlet cracked gas, obtaining cracked gas from a refinery to be used as ethylene plant inlet cracked gas, obtaining olefin rich gas from a catalytic dehydrogenation reactor;

(f) at least one means for compressing the ethylene plant inlet cracked gas in an ethylene plant inlet cracked gas compressor, receiving high pressure refinery cracked gas, receiving high pressure olefin rich gas from a catalytic dehydrogenation reactor;

(g) means for treating the compressed ethylene plant inlet cracked gas for acid gas removal including hydrogen sulfide ($H_2S$) and carbon dioxide ($CO_2$) gases;

(h) means for dehydrating the treated ethylene plant inlet cracked gas;

(i) at least one means for treating the dehydrated ethylene plant inlet cracked gas for acetylene removal through hydrogenation or through an acetylene recovery system, treating the ethylene plus mixture produced off the bottom of the ethylene plant demethanizer distillation column for acetylene removal through hydrogenation or through an acetylene recovery system, treating the fractionated components of the ethylene plus mixture coming from the bottom of the ethylene plant demethanizer distillation column for acetylene removal through hydrogenation or through an acetylene recovery system;

(j) means for chilling the ethylene plant inlet cracked gas in an ethylene plant demethanizer heat exchange train through one or a combination of heat exchange with internal ethylene plant or cryogenic natural gas liquid processing plant streams, external mechanical propane or propylene refrigeration, external mechanical ethane or ethylene refrigeration;

(k) means for demethanizing the chilled ethylene plant inlet cracked gas in an ethylene plant demethanizer distillation column with a vaporous and predominantly methane mixture coming off the top of the ethylene plant demethanizer and a liquid ethylene plus mixture produced off the bottom of the ethylene plant demethanizer;

(l) means for refluxing the ethylene plant demethanizer distillation column with a predominantly methane mixture from the cryogenic natural gas liquid processing plant; and (m) means for fractionating the ethylene plant ethylene plus liquid mixture in one or more distillation columns thereby producing olefins and other products.

* * * * *